US005926683A

United States Patent [19]

Yuminamochi et al.

[11] Patent Number: 5,926,683

[45] Date of Patent: Jul. 20, 1999

[54] IMAGE FORMING APPARATUS WITH TWO-POTENTIAL-LEVEL ELECTRICITY REMOVING MEMBER

[75] Inventors: Takayasu Yuminamochi, Kawasaki; Junichi Kimizuka, Yokohama; Tomohiro Nakamori, Ichikawa, all of Japan

[73] Assignee: Canon Kabushiki Kaisha, Tokyo, Japan

[21] Appl. No.: 08/618,763

[22] Filed: Mar. 20, 1996

[30] Foreign Application Priority Data

Mar. 22, 1995 [JP] Japan ..... 7-062608
Oct. 19, 1995 [JP] Japan ..... 7-271281

[51] Int. Cl.[6] ..... G03G 21/00

[52] U.S. Cl. ..... 399/398; 399/315; 271/900

[58] Field of Search ..... 399/398, 313, 399/315; 271/900

[56] References Cited

U.S. PATENT DOCUMENTS 3,620,615 11/1971 Volkers .
4,183,653 1/1980 Satomi et al. .
4,699,499 10/1987 Hoshika et al. .
4,728,991 3/1988 Takayama et al. .
4,739,363 4/1988 Hoshika et al. .
5,235,386 8/1993 Yano et al. ..... 355/219
5,541,718 7/1996 Oono .

FOREIGN PATENT DOCUMENTS 0 473 161 A2 3/1992 European Pat. Off. .
61-262750 11/1986 Japan .
1-269969 10/1989 Japan .
4-19976 1/1992 Japan .

*Primary Examiner*—Richard Moses
*Attorney, Agent, or Firm*—Fitzpatrick, Cella, Harper & Scinto

[57] ABSTRACT

The present invention relates to an image forming apparatus which comprises an image bearing member for bearing a toner image, a transfer charger for transferring the toner image from the image bearing member to a transfer material, and an electricity removing member for removing electricity from the transfer material to separate the transfer material from the image bearing member, and wherein, when the electricity is removed from the transfer material by the electricity removing member, a potential level applied to the electricity removing member is selected so that the potential level at end portions of the transfer material becomes greater than the potential level at a central portion of the transfer material along a transfer material shifting direction, thereby improving separation of the transfer material from the image bearing member.

30 Claims, 27 Drawing Sheets

IMAGE FORMING APPARATUS WITH TWO-POTENTIAL-LEVEL ELECTRICITY REMOVING MEMBER

BACKGROUND OF THE INVENTION

1. Field of the Invention

The present invention relates to an image forming apparatus having a transfer charger for transferring an image formed on an image bearing member onto a transfer material, and an electricity removing member for removing electricity from the transfer material in order to separate the transfer material from the image bearing member.

The image forming apparatus may be of electrophotographic type or of electrostatic type.

2. Related Background Art

In the past, there have been proposed image forming apparatuses in which a toner image formed on a photosensitive drum (image bearing member) is transferred onto a transfer material by a transfer roller to which voltage is applied and electricity is removed from the transfer material by an earthed electricity removing needle (electricity removing member) in order to separate the transfer material from the photosensitive drum. After the transferring operation, residual toner remaining on the photosensitive drum is removed by a cleaning device, and the toner image transferred to the transfer material is fixed to the transfer material by a fixing device.

However, depending upon the kinds of the transfer materials and/or an environmental condition, when the transfer material is separated from the photosensitive drum, the transfer material often cannot be separated from the photosensitive drum effectively.

On the other hand, when the transfer material is separated from the photosensitive drum, if a trail end of the transfer material is charged with the same polarity as that of the transfer voltage by peel charge, the separation of the trail end of the transfer material from the photosensitive drum will be often delayed. If separation of the trail end of the transfer material from the photosensitive drum is delayed, the trail end of the transfer material will be pulled toward a direction to which the drum is rotated. Consequently, due to "transfer material trail end splash" having the tendency of splashing the trail end of the transfer material toward the drum, the trail end of the transfer material is contacted with a bottom of a cleaning container of the cleaning device to distort the non-fixed toner image on the transfer material or to smudge the trail end of the transfer material by the toner scattered and adhered to the bottom of the cleaning container. Particularly, when the above-mentioned transfer roller is used as a transfer material, since the transfer material is closely contacted with the transfer roller, the above problem becomes more serious.

In order to eliminate the poor separation problem, if the electricity is forcibly removed from the transfer material by applying great voltage having the same charging polarity as that of the toner image to the electricity removing needle, the potential of the transfer material will be decreased, with the result that an electrostatic force for holding the non-fixed toner image on the transfer material is weakened. Consequently, when the transfer material holding the non-fixed toner image thereon is sent to the fixing device, since so-called "fixing offset" occurs (i.e., the toner image on the transfer material is electrostatically adhered to a fixing roller), the image is distorted and/or smudged.

Further, when the great voltage having the same charging polarity as that of the toner image is applied to the electricity removing needle, if moisture is absorbed to the transfer material under the high temperature/high humidity environment, a so-called "transfer void" problem will occur. The transfer void is poor transfer caused when the transfer charge to be applied from the transfer roller to the transfer material to effect the transferring of the toner image cannot be held on the transfer material due to the reduction of resistance of the transfer material to escape to the electricity removing needle.

SUMMARY OF THE INVENTION

An object of the present invention is to provide an image forming apparatus in which electricity is properly removed from a transfer material by means of an electricity removing member.

Another object of the present invention is to provide an image forming apparatus in which, when a transfer material is separated from an image bearing member, a trail end of the transfer material is prevented from being excessively pulled toward the image bearing member.

A further object of the present invention is to provide an image forming apparatus in which a non-fixed image is prevented from being distorted due to a small electrostatic force between a transfer material and the non-fixed image after a transferring operation.

A still further object of the present invention is to provide an image forming apparatus which can prevent "transfer offset".

A further object of the present invention is to provide an image forming apparatus which can prevent "transfer void" if moisture is absorbed to a transfer material.

The other objects and features of the present invention will be apparent from the following detailed description of the present invention referring to the accompanying drawings.

DETAILED DESCRIPTION OF THE PREFERRED EMBODIMENTS

The present invention will now be explained in connection with embodiments thereof with reference to the accompanying drawings.

Figure 1:
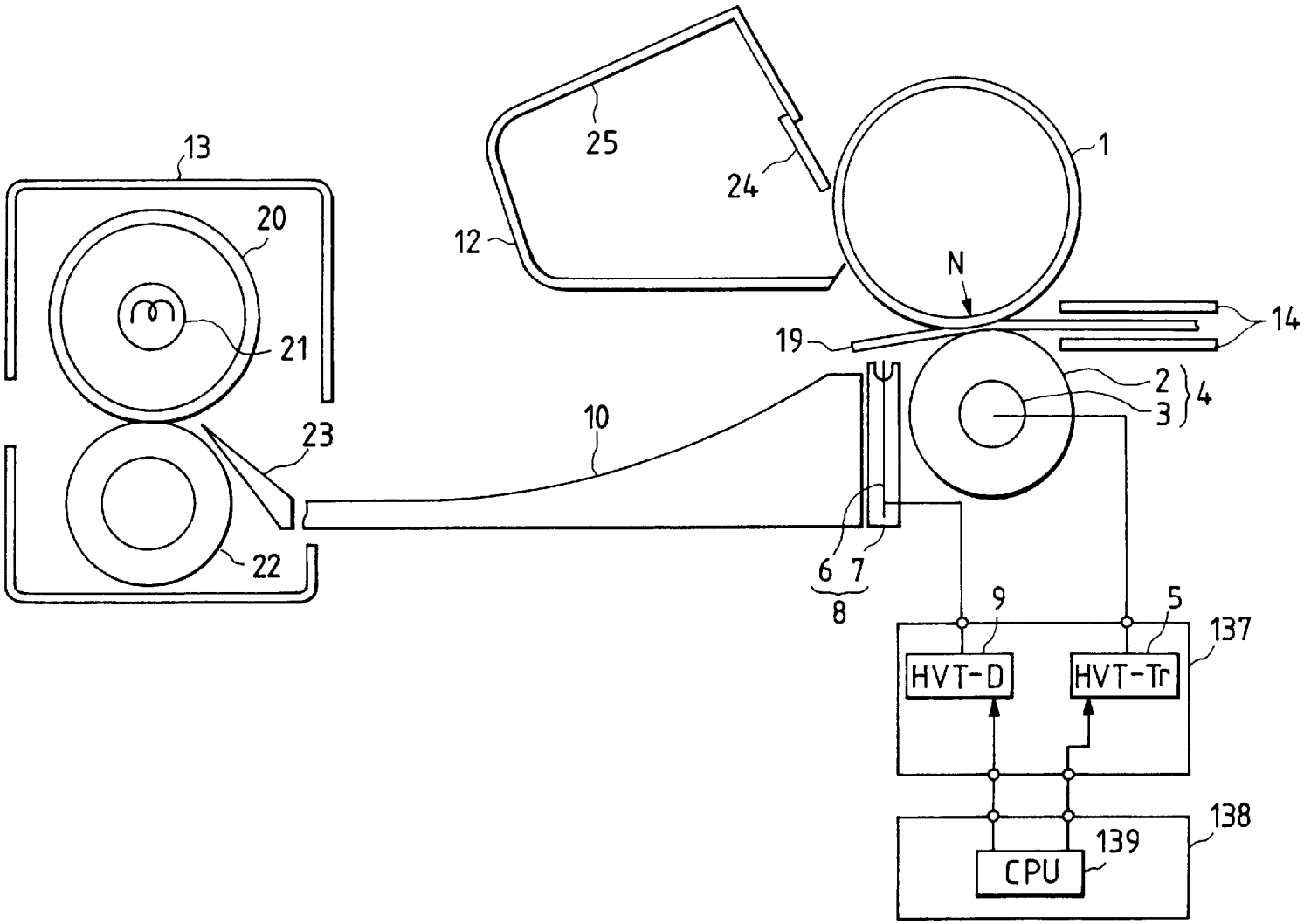
FIG. 1 is a schematic illustration showing an image forming apparatus according to a first embodiment of the present invention.

FIG. 1 is a side view showing a part of a transfer portion of an image forming apparatus according to a first embodiment of the present invention. A photosensitive drum 1 is constituted by coating an organic photosensitive (OPC) layer on an earthed aluminium cylinder and having an outer diameter of 30 mm. In order to improve separation of a transfer material (transfer sheet) from the drum, the outer diameter of the drum may be 40 mm or less. After the photosensitive drum 1 is charged uniformly and negatively by a charge device (not shown), image exposure is effected on a surface of the drum to form a latent image on the drum surface. The latent image is developed by a developing means (not shown) in a reverse rotation (inversion) manner to form a toner image on the drum surface. The toner image is transferred to the transfer sheet (transfer material) 19 conveyed along a transfer guide 14.

The transferring operation is effected by a transfer nip N defined between the photosensitive drum 1 and a transfer charger or transfer roller 4 (comprised of a metal core 3 and a conductive elastic layer 2 formed on the core and having an outer diameter of 20 mm) by applying positive voltage having charging polarity opposite to that of the toner image from a transfer high voltage source 5 to the transfer roller 4. Volume resistivity of the elastic layer 2 of the transfer roller 4 is about $10^6$–$10^{10}$ Ωcm, and the transfer voltage applied to the core 3 of the transfer roller is about from +1 kV to +6 kV.

Figure 17:
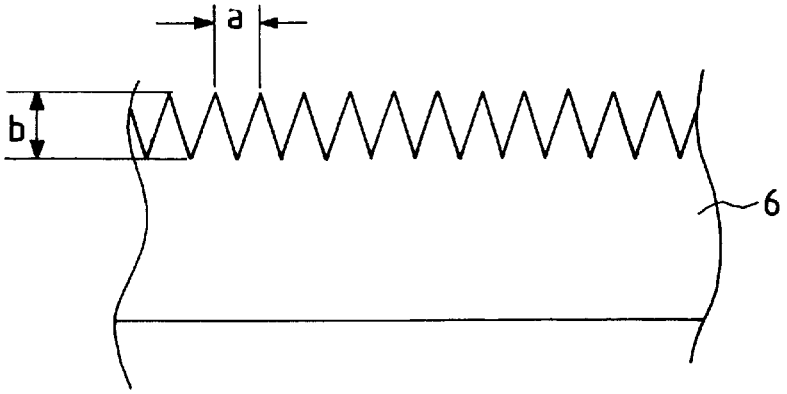
FIG. 17 is an enlarged front view of the electricity removing needle.

After the transferring operation, the transfer sheet 19 is still adhered to the photosensitive drum electrostatically. An electricity removing needle 6 serves to separate the transfer sheet from the drum. The electricity removing needle 6 is constituted by an SUS plate having a thickness of 0.1 mm, and a tip end of the needle has a saw-shaped edge as shown in FIG. 17. A pitch a between tops in the saw-shaped edge of the electricity removing needle is 1 mm, and a height b from the bottom to the top is 2 mm.

The electricity removing needle 6 is pinched by an insulation member 7 to form an electricity removing needle unit 8. The electricity removing needle 6 serves to remove electricity from the sheet 19 and to promote the separation of the sheet from the photosensitive drum 1. The top of the electricity removing needle 6 is located at a position spaced apart from a center of the transfer nip N by 10.8 mm in a horizontal direction and by 6.4 mm in a vertical direction (below the nip), and predetermined potential is applied to the electricity removing needle 6.

After the sheet 19 is separated from the drum, the sheet is conveyed on an insulation resin convey guide 10 to reach a fixing device 13. The fixing device 13 comprises a fixing roller 20 (constituted by an aluminium cylindrical core and a PFA (per-alkoxyl fluoride) layer coated on the core), a halogen heater 21 disposed within the fixing roller to heat the fixing roller from the inside, a pressure roller 22 for urging the sheet 19 against the fixing roller 20, and a fixing inlet guide 23 for directing the sheet 19 to a nip between the fixing roller 20 and the pressure roller 22.

After the transferring operation, the sheet 19 is passed through the nip; meanwhile, the toner image is fixed to the sheet.

Incidentally, the residual toner remaining on the photosensitive drum 1 (not transferred to the sheet in the transferring process) is collected or gathered by a cleaning device 12. The cleaning device comprises a cleaning blade 24 for scraping the residual toner from the drum, and a cleaning container (referred to as "C container" hereinafter) for collecting waste toner. The magnitude of the voltage applied to the transfer roller 4 can be changed by the resistance value of the transfer roller and can be switched between the transferring condition and a non-transferring or inoperative condition. The control of the change of the voltage value is performed by a control portion 138 including a CPU 139 and the like.

Now, the above-mentioned problems will be fully described.

Figure 2:
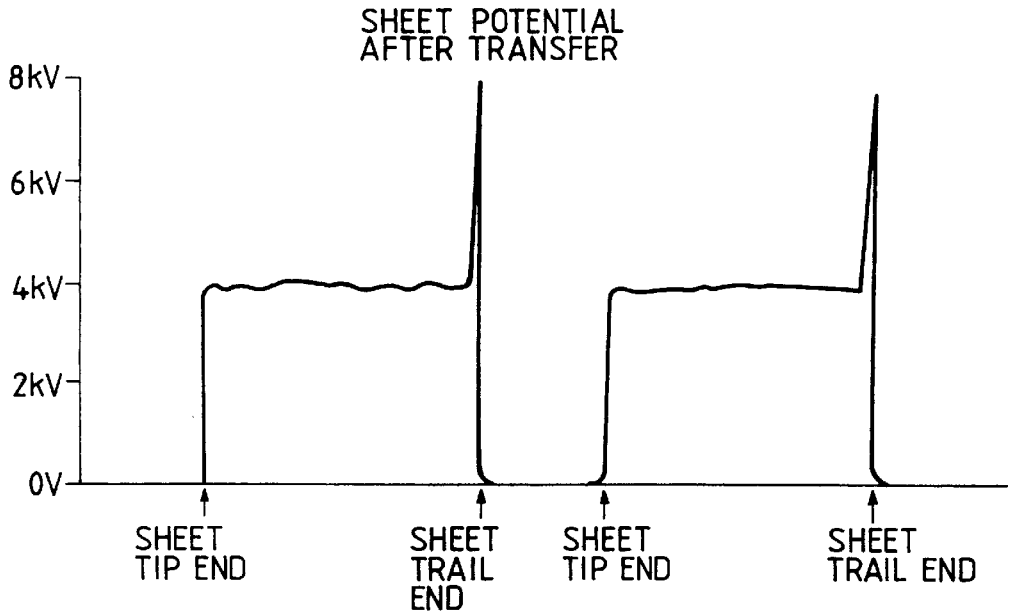
FIG. 2 is a graph showing sheet potential after transfer.
Figure 3:
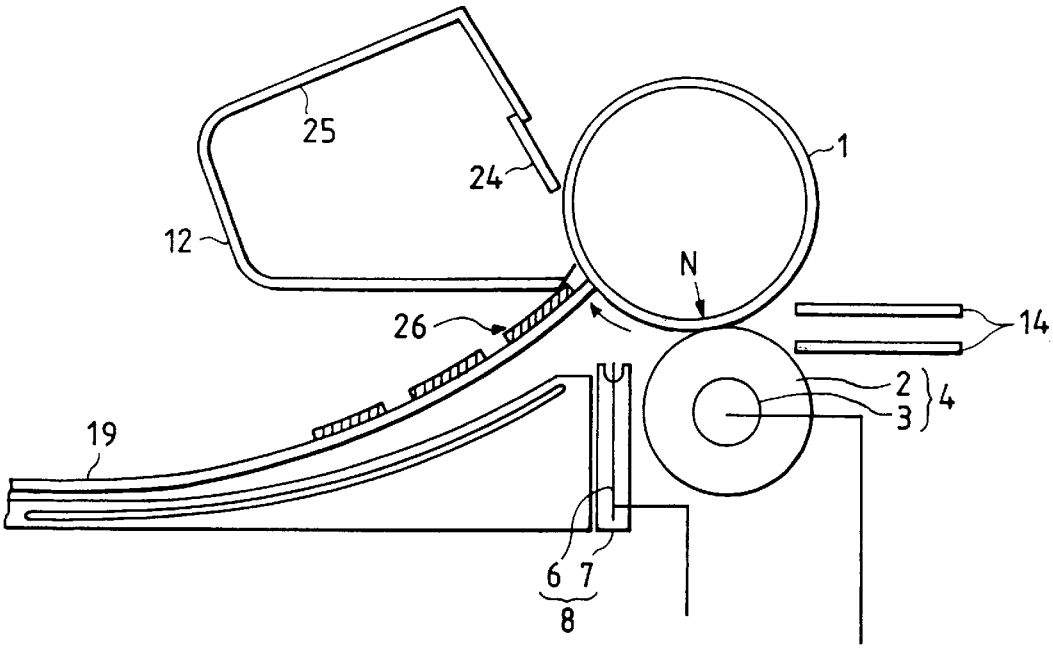
FIG. 3 is an explanatory view showing a trail end splash phenomenon in which a trail end of a transfer material is absorbed to a photosensitive drum.

(1) When the electricity removing needle (electricity removing member) 6 is always earthed during the passage of the transfer sheet, as shown in FIG. 2, since a trail end of the sheet 19 is positively charged greatly by peel charge upon the separation of the sheet from the photosensitive drum 1, so-called "trail end splash" having tendency of delaying the separation of the trail end of the sheet from the drum as shown in FIG. 3 occurs, thereby causing a problem that the trail end of the sheet is contacted with a bottom of the C container to distort or rub a non-fixed toner image 26 or to smudge the trail end of the sheet by the toner scattered and adhered to the bottom of the container.

(2) In order to solve the above problem, it is considered that great negative voltage having the same charging polarity as that of the toner image is applied to the electricity removing needle to forcibly remove the electricity from the sheet.

Figure 4:
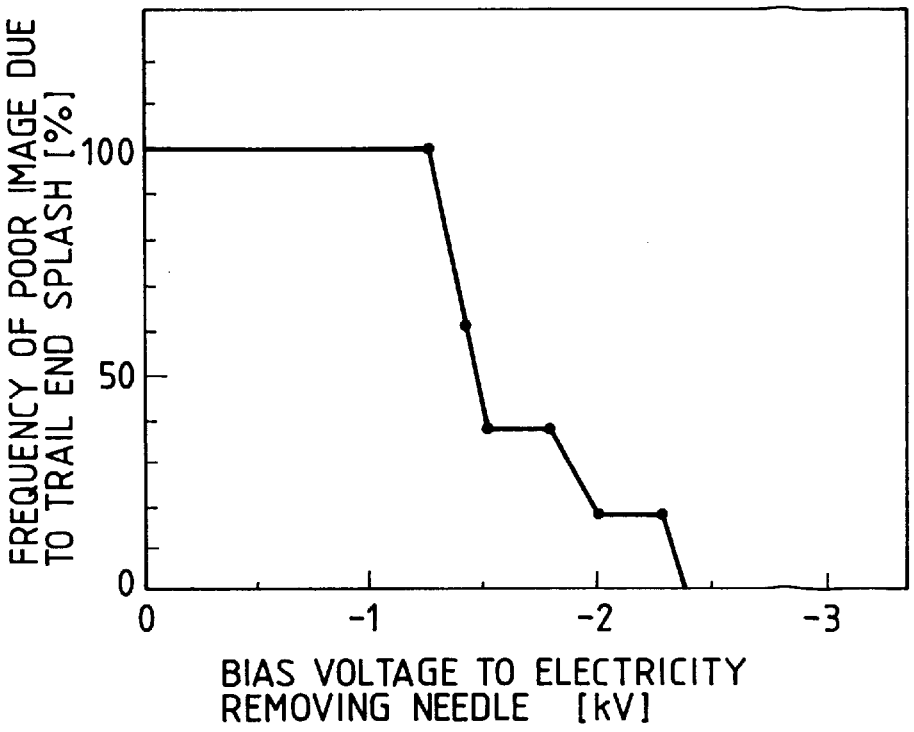
FIG. 4 is a graph showing a relation between bias voltage to an electricity removing needle and a trail end splash.
Figure 5:
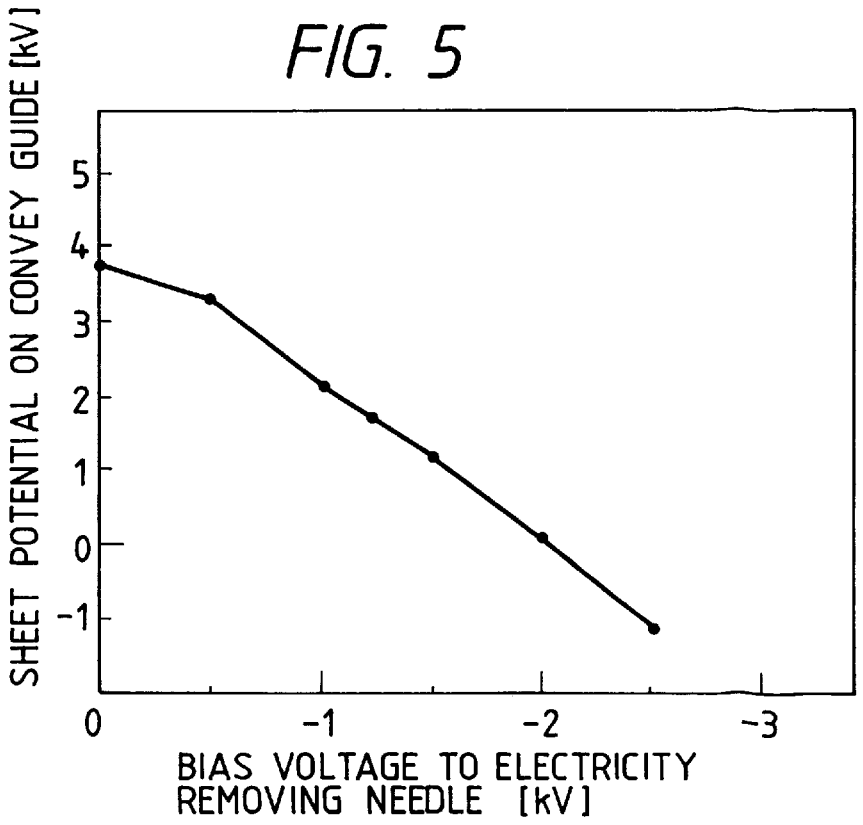
FIG. 5 is a graph showing a relation between bias voltage to an electricity removing needle and sheet potential.

FIG. 4 is a graph showing a relation between bias voltage applied to the electricity removing needle and frequency of poor image due to the trail end splash. By forcibly removing the electricity from the sheet in this way, an electrostatic absorbing force for absorbing the trail end of the sheet to the drum is decreased, thereby preventing the poor image due to the trail end splash. In the illustrated embodiment, in order to prevent the poor image completely, the voltage level greater than −2.5 kV is preferably applied to the electricity removing needle. However, as the great voltage level bias is applied to the electricity removing needle, as shown in FIG. 5 showing a relation between bias voltage applied to the electricity removing needle and sheet potential, since the sheet voltage is gradually decreased, the electrostatic force for holding the toner on the sheet 19 is weakened, thereby causing a problem that "fixing offset" likely occurs.

The "fixing offset" is a phenomenon in which the non-fixed toner on the sheet 19 is not completely fixed to the sheet in the fixing nip but is partially transferred to the fixing roller electrostatically, thereby smudging the sheet with toner when the sheet is passed through the fixing nip. A relation between the "fixing offset" and the voltage of the electricity removing needle is shown in Table 1.

TABLE 1

(relation between voltage of electricity removing needle and offset)

| Voltage of electricity removing needle | Fixing offset | Reference |
|---|---|---|
| 0 V | ○ | |
| −500 V | ○ | |
| −1 kV | ○ | |
| −1.2 kV | ○ | |
| −1.5 kV | Δ | small offset |
| −2 kV | x | |
| −2.5 kV | x | very bad level |

In the illustrated embodiment, the "fixing offset" does not occur until the voltage of the electricity removing needle reaches −1.2 kV or less, but occurs when the voltage of the electricity removing needle is decreased below −1.2 kV.

(3) In order to eliminate the problem regarding the "trail end splash", when the voltage applied to the electricity removing needle (having the polarity opposite to that of the voltage applied to the transfer roller) is increased greater than the voltage applied to the transfer roller in an absolute value, if the moisture is absorbed to the paper sheet 19 under a high humidity condition, a problem regarding "transfer void" will occur. The "transfer void" is poor transfer caused when the transfer charge (current) to be applied from the transfer roller to the transfer sheet to effect the transferring of the toner image cannot be held on the transfer material due to the reduction of resistance of the transfer sheet to escape to the electricity removing needle.

Figure 6:
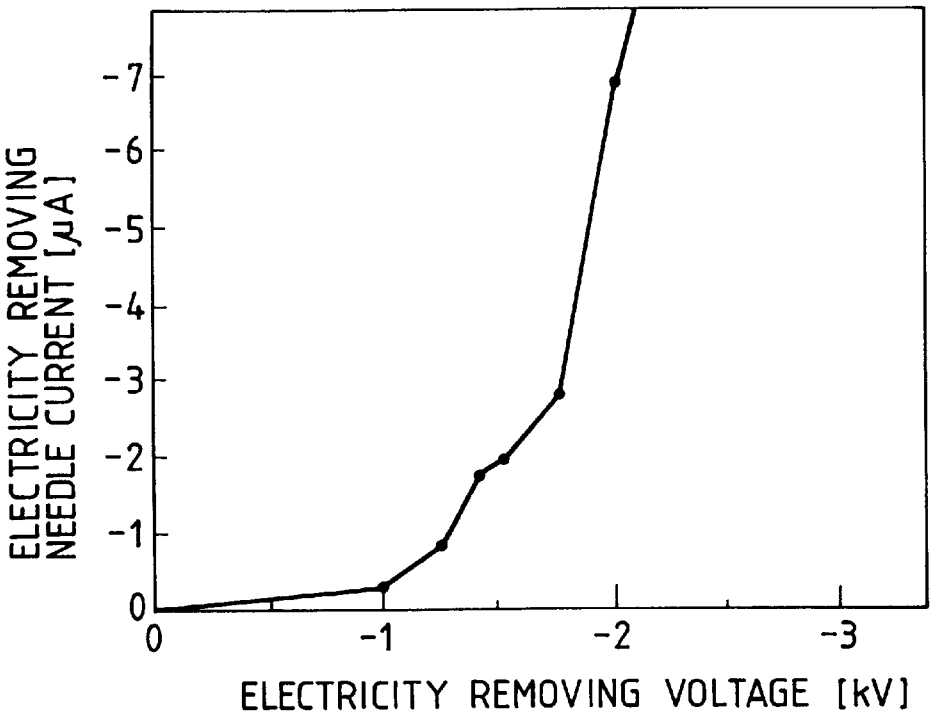
FIG. 6 is a graph showing a relation between bias voltage to an electricity removing needle and electricity removing needle current.

FIG. 6 is a graph showing a relation between bias voltage applied to the electricity removing needle and current flowing from the transfer roller to the electricity removing needle when the moisture is absorbed to the sheet (transfer material) under the high temperature/high humidity condition (32.5° C., 85%). As is apparent from FIG. 6, the greater the voltage applied to the electricity removing needle, the greater the current will be flowing from the transfer roller to the needle. In this case, a relation between the electricity removing needle voltage and the "transfer void" is shown in a Table 2.

TABLE 2

(relation between electricity removing needle voltage and transfer void)

| Voltage of electricity removing needle | Level of transfer void | Reference |
|---|---|---|
| 0 v | ○ | normal |
| −1 kV | ○ | normal |
| −1.2 kV | ○ | normal |
| −1.4 kV | ○ | normal |
| −1.5 kV | Δ | partial image density decrease |
| −1.7 kV | Δ | partial image dencity decrease |
| −2 kV | x | partial poor transfer |
| −2.5 kV | x | whole poor transfer |

As apparent from the Table 2, if the voltage of the electricity removing needle is decreased below −1.4 kV, the poor image due to the "transfer void" will occur.

Figure 8:
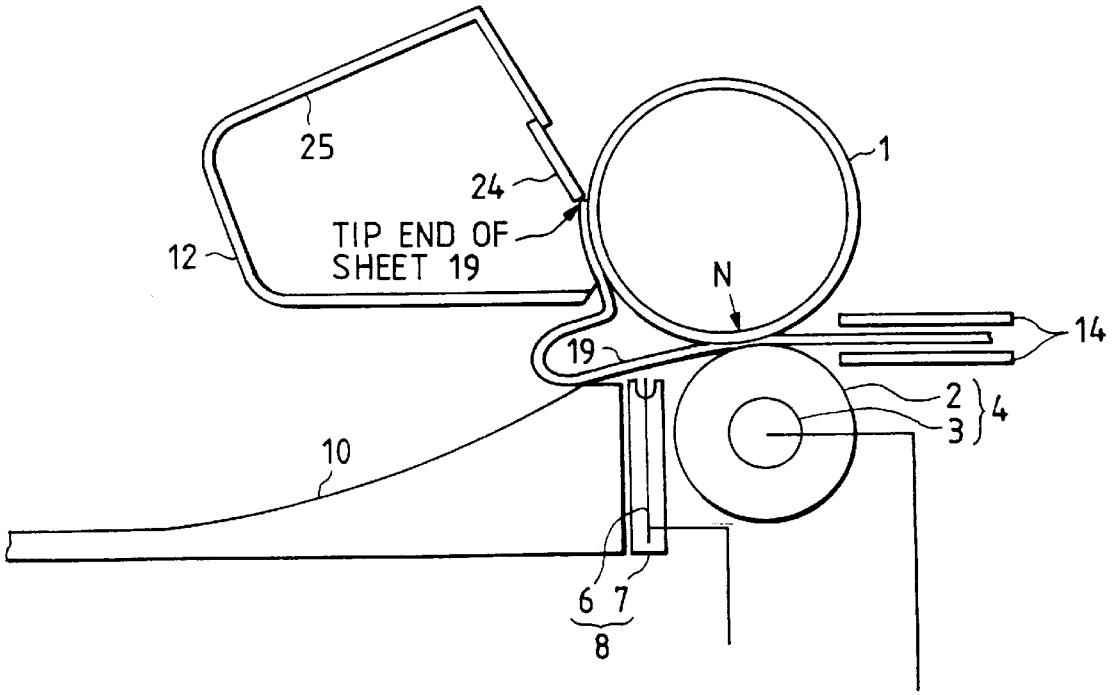
FIG. 8 is an explanatory view for explaining sheet jam due to the poor separation.

(4) On the other hand, the reason why the outer diameter of the photosensitive drum 1 is selected to 30 mm is to anticipate a separation action (curvature separation) of the sheet from the drum due to resiliency (bending stiffness) of the transfer sheet. It is preferable that the outer diameter of the drum 1 is smaller than 40 mm. When a sheet having small resiliency is used or when a sheet curled in the same direction as the curvature of the drum after the image was formed on one surface of the sheet is re-supplied as is in a both-face printing mode, since the curvature separation action is small, it is hard to separate a tip end of the sheet from the drum, thereby causing a problem that a sheet jam occurs as shown in FIG. 8. In order to eliminate this problem, it is considered that great negative bias voltage should be applied to the electricity removing needle.

Figure 7:
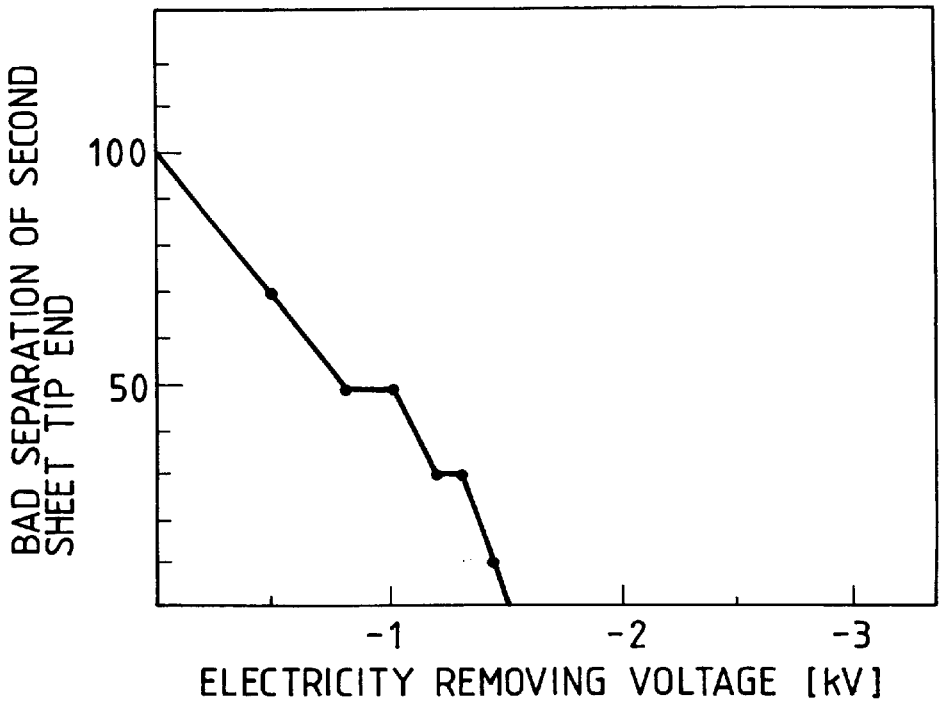
FIG. 7 is a graph showing a relation between bias voltage to an electricity removing needle and poor (bad) separation of a second sheet.

FIG. 7 is a graph showing a relation between electricity removing needle voltage and poor (bad) separation of the second sheet tip end. The measurement is effected by using a sheet having a weight (per unit) of 65 g/m$^2$ to which moisture is absorbed under a high humidity condition to facilitate curling of the sheet (heat curl in the fixing operation), and the poor separation is indicated as a frequency (%) of occurrence of poor separation. In this case, the curled amount of the sheet was measured by measuring a height difference between a surface of the flat plate and a tip end of the second sheet when the sheet removed from the apparatus after the fixing operation regarding the first surface of the sheet was finished is rested on the flat plate. As a result, it was found that the curled amount is 40 mm.

As can be seen from the relation between the electricity removing needle voltage and the poor separation of second sheet tip end as shown in FIG. 7, the poor separation can be eliminated by selecting the voltage of the electricity removing needle to −1.5 kV or more. However, also in this case, if the voltage of the electricity removing needle is decreased below −1.5 kV, the poor image due to the "fixing offset" and the "transfer void" under the high humidity condition will occur.

Figure 9:
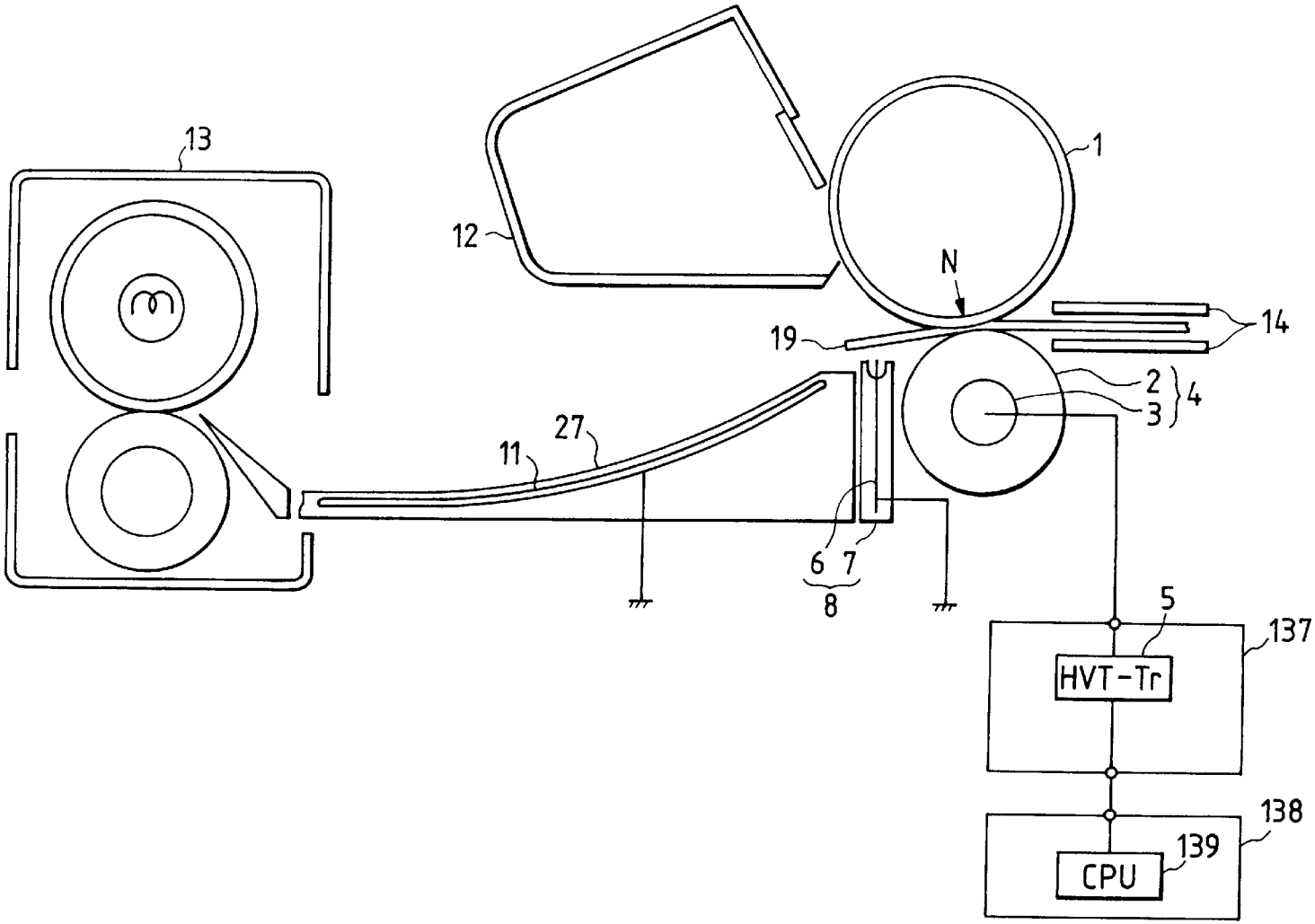
FIG. 9 is a schematic illustration showing an image forming apparatus according to a second embodiment of the present invention.

(5) When the sheet is conveyed in a direction perpendicular to a sheet handling direction and along a small resiliency direction of the sheet and when the sheet after transferring is conveyed in a relatively horizontal direction and when a distance between the transfer portion and the fixing nip is greater than 100 mm and a sheet conveying speed is greater than 45 mm/sec, it is likely to occur the poor conveyance (unstable conveyance) of the sheet by the curl in the sheet and/or a floating force of the sheet due to resistance of air. In order to prevent this and to stabilize the sheet conveyance, as shown in FIG. 9, it is desirable that the convey guide for guiding the sheet to which the toner image was transferred has a sheet contacting portion constituted by comb-shaped insulation resin ribs 27, and the sheet absorbing metal plate 11 electrically earthed are disposed between the ribs 27.

With this arrangement, the sheet is stably conveyed by shifting the sheet on tops of the ribs 27 while electrically absorbing the sheet charged positively after transferring by the earthed metal plates 11. However, the charged amount of the paper sheet is apt to be changed in accordance with the moisture absorbed to the sheet.

Figure 10:
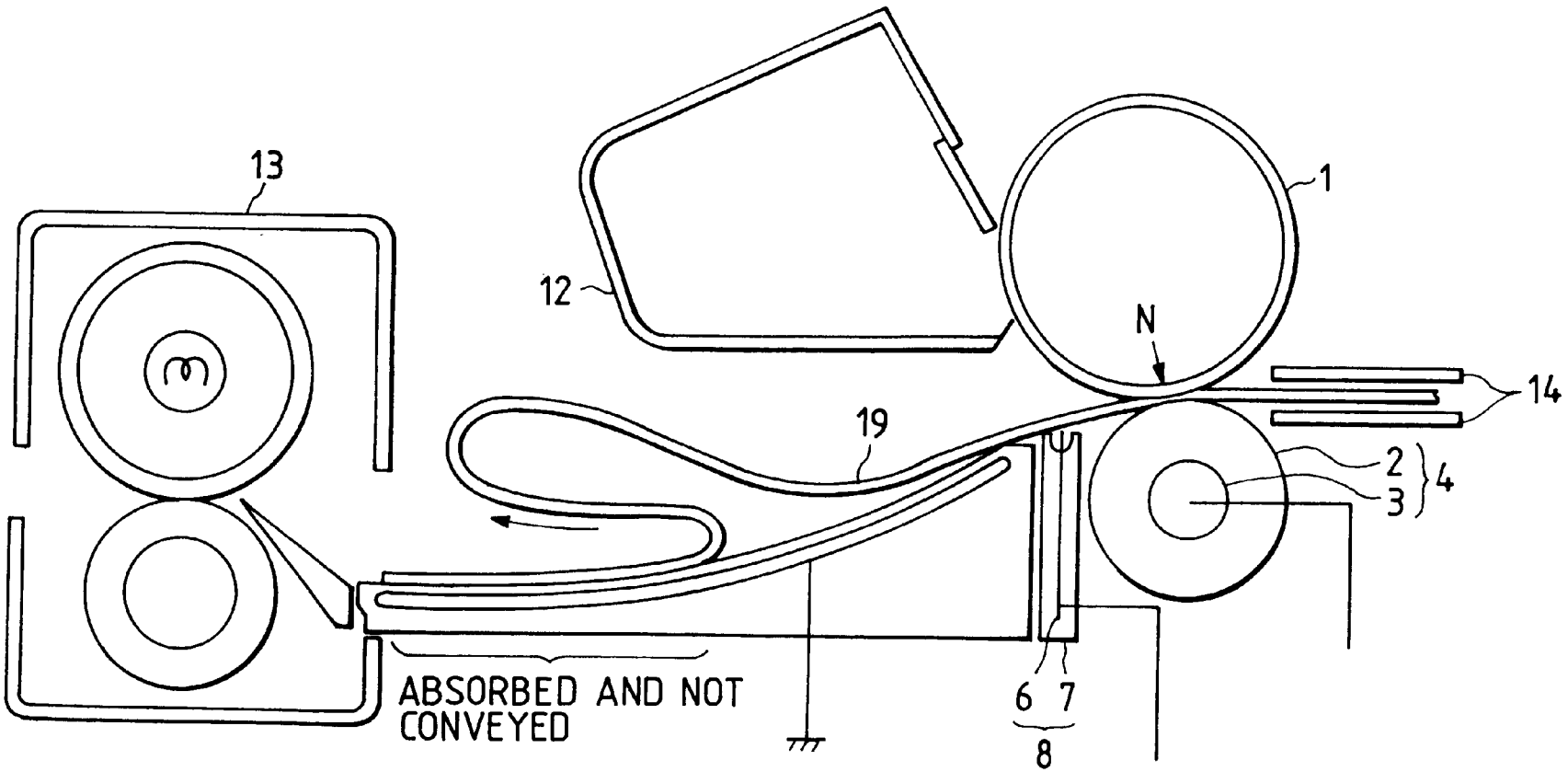
FIG. 10 is an explanatory view for explaining sheet jam in a convey guide.

When the potential of the paper sheet is increased in the positive value, if the lateral sheet passage (in which the sheet handling direction is perpendicular to the sheet conveying direction) is adopted or if a sheet having small resiliency (such as a thin sheet having a weight of 60 g/m$^2$ or less) is used, the absorbing force between the paper sheet and the convey guide, the conveying force of the sheet in the transfer portion and the resiliency of the sheet for changing the conveying force into the conveyed amount of the sheet become unbalanced, with the result that, as shown in FIG. 10, the sheet is stopped on the convey guide, thereby causing the sheet jam. In order to avoid such sheet jam, it is effective to control the potential of the sheet by applying the voltage to the electricity removing needle. In this case, however, if the electricity is removed from the paper sheet excessively, the absorbing force of the metal plates for absorbing the sheet is decreased to make the sheet conveyance unstable.

Figure 11:
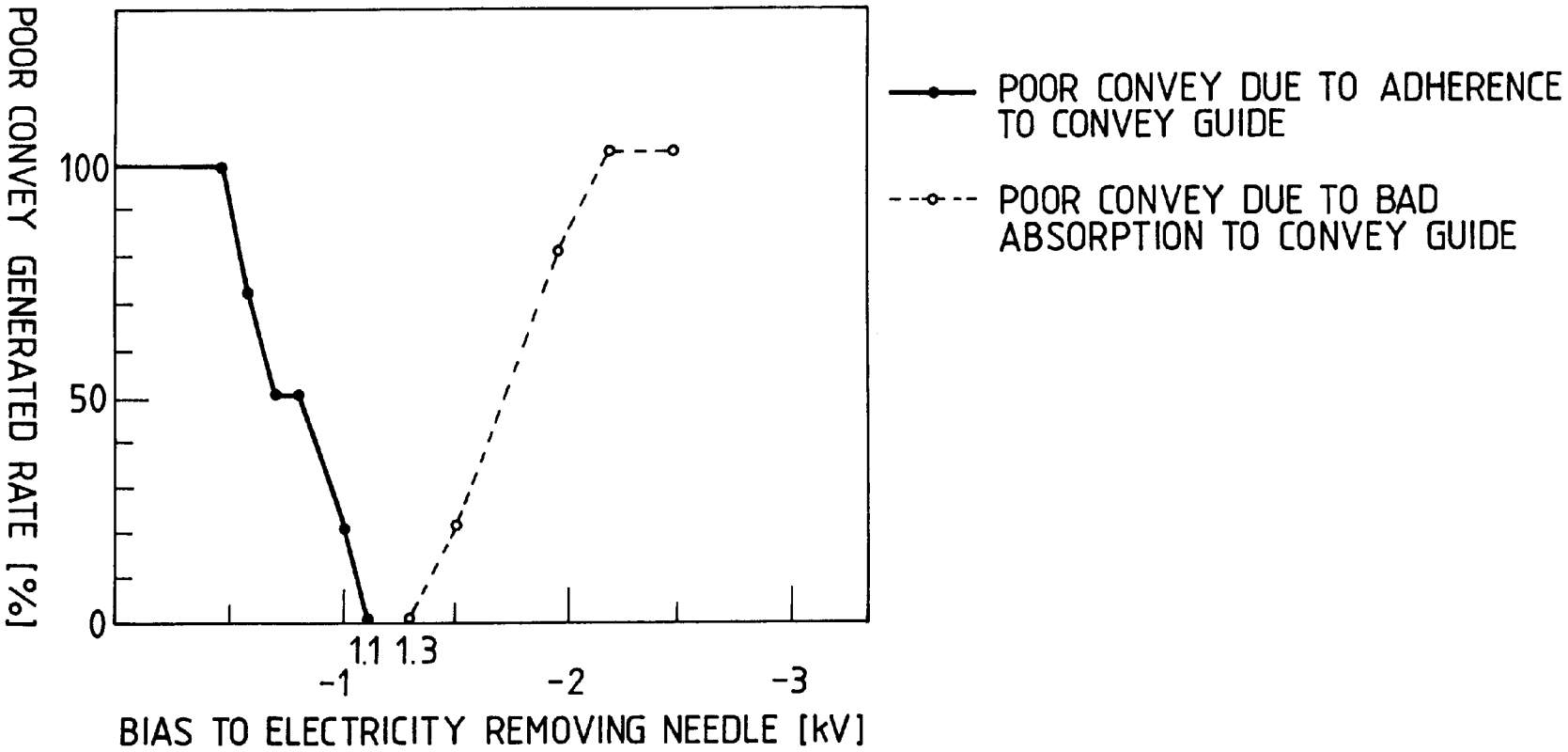
FIG. 11 is a graph showing a relation between bias voltage to an electricity removing needle and sheet convey on a convey guide.

FIG. 11 is a graph showing a relation between the bias voltage applied to the electricity removing needle and the sheet conveyance on the convey guide. As apparent from FIG. 11, it was found that the voltage of the electricity removing needle should be maintained between −1.1 kV and −1.3 kV to prevent the poor conveyance of the sheet due to the electrostatic absorption of the sheet to the convey guide and the poor absorption. For example, by selecting the voltage of the electricity removing needle to −1.2 kV, the sheet conveyance is stabilized to prevent the poor image due to the "fixing offset" and the "transfer void" under the high humidity condition. Also in this case however, there arises a problem that the above-mentioned "trail end splash" and/or the poor separation of the second sheet tip end occur.

In order to eliminate this problem, the potential applied to the electricity removing needle is controlled as follows:

First embodiment

Figure 12:
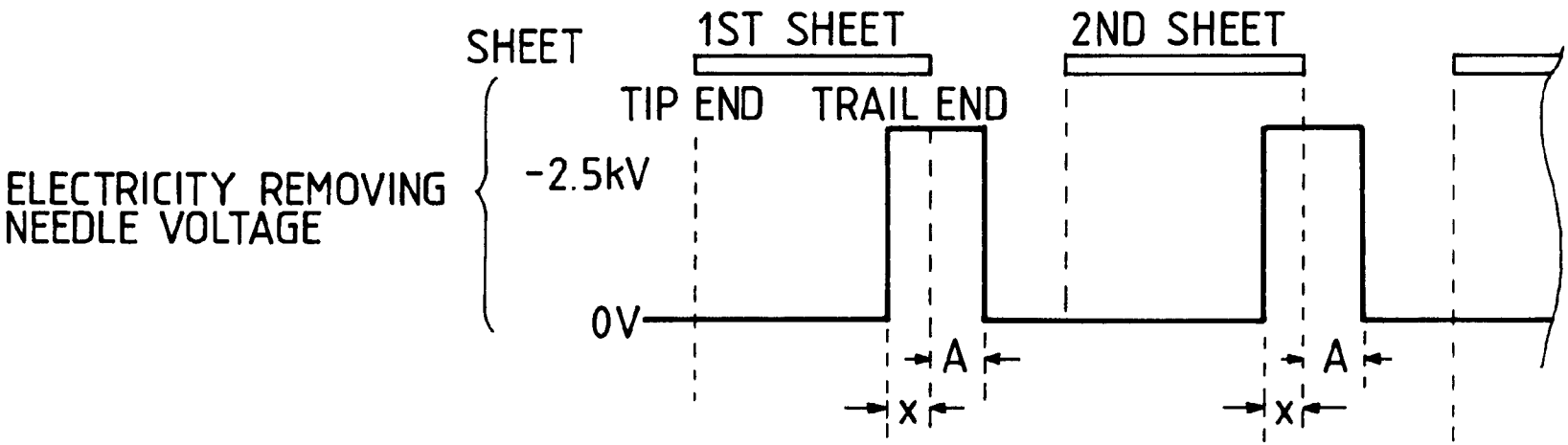
FIG. 12 is a sequence chart showing a sequence for applying voltage to the electricity removing needle according to the first embodiment.

According to this first embodiment, in the apparatus shown in FIG. 1, the potential applied to the electricity removing needle 6 is changed or switched between −2.5 kV (potential for preventing the occurrence of the trail end splash) and 0 kV (potential for removing the electricity moderately without occurring the "fixing offset" and the "transfer void" under the high humidity condition). The potential is switched when the paper sheet has just passed through the electricity removing needle. A sequence for effecting the switching is shown in FIG. 12. As shown in FIG. 12, the potential applied to the electricity removing needle 6 is switched so that the potential on the sheet becomes 0 kV from the tip end to the vicinity of a central portion of the sheet (ahead of the trail end) and becomes −2.5 kV in the vicinity of the trail end.

When the switching of the potential of the electricity removing needle is effected at a position spaced apart from the trail end of the sheet by x mm, it is desirable to determine the distance x as follows.

(1) First of all, the potential must be risen sufficiently before the trail end of the sheet leaves the transfer nip. In consideration of the rising feature of the high voltage source (electricity removing needle source 9), it is desirable that the potential is risen ahead of the trail end of the sheet as much as possible.

(2) Then, in a condition that the image on the sheet is in the transfer nip, if the great potential is applied to the electricity removing needle, the "transfer void" will occur under the high humidity condition. To avoid this, it is desirable that the switching of the potential from 0 kV to −2.5 kV is effected after the image leaves the transfer nip (i.e., a rear margin on which the image was not formed leaves a rear end of the transfer nip).

By considering the above-mentioned two conditions (I) and (II), the switching timing x of the potential from 0 kV to −2.5 kV is a point that the rear margin of the sheet reaches the rear half of the transfer nip, and the switching value can be calculated as follows:

When a distance between the transfer nip (point on which a line connecting between a center of the transfer roller and a center of the photosensitive drum intersects with a periphery of the photosensitive drum) and the electricity removing needle is L (mm), a width of the rear margin is m (mm) and a width of the transfer nip is n (mm):

$$x=L+m-(\tfrac{1}{2}\times n).$$

Further, in this case, it is desirable that the rising feature of the electricity removing needle source 9 has the following value. That is to say, when a time period for changing from 0 kV to −2.5 kV after an input signal is received is t (sec) and a sheet conveying speed is p (mm/sec), the time period t is determined as follows:

$$t=m/p.$$

In the illustrated embodiment, L is selected to 12.6 mm $$\left(\cong\sqrt{10.8^2+6.4^2}\right).$$

When the width m of the rear margin is 5 mm, the width n of the transfer nip is 2.5 mm and the sheet conveying speed is 40 mm/sec, the values x and t are calculated as follows:

$$x=12.6+5-2.5\div 2=16.35\ \text{(mm), and}$$

$$t=5/40=0.125\ \text{(sec).}$$

Incidentally, a symbol A shown in FIG. 12 (i.e., timing for returning from −2.5 kV to 0 kV) can be selected at any time after the trail end of the sheet is separated from the photosensitive drum sufficiently, and, in this case, the timing is selected to the time point when the trail end of the sheet is spaced apart from the electricity removing needle by 10 mm. In this way, it is possible to prevent the poor image such as the image deterioration and the trail end smudge due to the "trail end splash" without occurring the "transfer void" under the high humidity condition.

Incidentally, when the setting is performed in the above-mentioned manner, the voltage of the electricity removing needle is applied to a rear end image area of 11.35 mm (16.35 mm−5 mm) of the transfer sheet. However, when the voltage was actually applied to the rear end image area, it was found that the fixing offset did not occur. The reason is considered that, since the bias voltage is applied to the narrow area of the sheet, the fixing roller performs the next revolution soon, and, thus, if the amount of toner transferred to the fixing roller is small, the image contamination becomes unnoticeable. As a result, the fixing offset became an acceptable level.

Second embodiment

Figure 18:
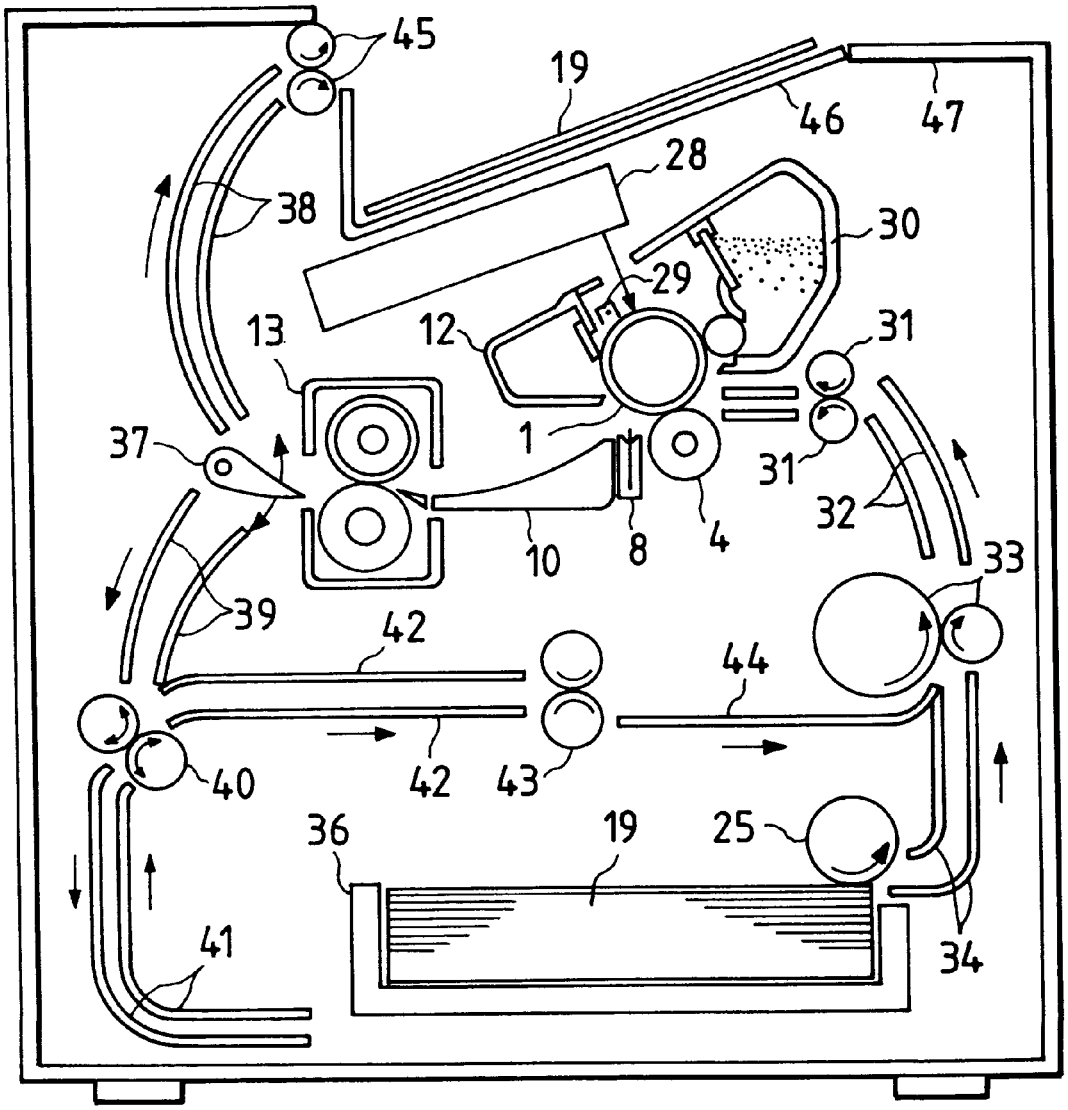
FIG. 18 is an elevational sectional view of the image forming apparatus according to the second embodiment of the present invention.

A second embodiment of the present invention will be explained in connection with the case where images are printed on both surfaces of the sheet or where a thin sheet having small resiliency is used. An example of an image forming apparatus in which the images can be printed on both surfaces of the sheet is shown in FIG. 18. In FIG. 18, the same elements as those shown in FIG. 1 are designated by the same reference numerals.

In the image forming apparatus shown in FIG. 18, when the images are printed on both surfaces of the sheet, first of all, sheets 19 contained in a sheet cassette 36 are separated one by one by a sheet supply roller 25, and the separated sheet is conveyed to a pair of convey rollers 33 along a guide 34. The sheet 19 is further conveyed by the rotation of the convey roller pair 33 to reach a pair of regist rollers 31 along a guide 32. The pair of regist rollers 31 are rotated in synchronous with the toner image formed on the photosensitive drum 1 to send the sheet to the transfer nip.

Regarding the image formation on the photosensitive drum 1, first of all, after the photosensitive drum is uniformly charged by a charger 29, the drum is exposed by an exposure device 28, thereby forming an electrostatic latent image on the drum. The latent image is developed by a developing device 30 to form a toner image. The toner image is transferred onto the sheet 19, and, then, the sheet is sent to a fixing device 13, where the toner image is fixed to the sheet, thereby obtaining the image. The sheet discharged from the fixing device 13 is directed to a downward direction by a rotatable flapper 37 to reach a reverse rotation roller 40 along guides 39.

Then, the sheet 19 is temporarily entered between guides 41 by normal rotation of the reverse rotation roller 40 and then is sent to a pair of convey rollers 43 along guides 42 by reverse rotation of the reverse rotation roller 40 with the surface of the sheet turned over. The pair of convey rollers 43 convey the sheet 19 to the pair of convey rollers 33, and, then, the sheet 19 (particularly, the other surface thereof on which an image is not formed) is again subjected to the image transferring process and the fixing process.

After the image was fixed to the other surface (second surface) of the sheet 19, the sheet is directed to an upward direction by the flapper 37 to reach a pair of discharge rollers 45 along guides 38 and then is discharged onto a sheet discharge tray 46. Incidentally, in FIG. 18, the reference numeral 47 denotes a frame of the image forming apparatus.

Further, an operation panel is provided with a selection switch by which an operator can select a one-face image formation mode in which the image is formed on a single surface of the sheet or a both-face image formation mode in which the images are formed on both surfaces of the sheet. Thus, by selecting either of the above two modes, the image is formed on the single surface of the sheet or the images are formed on both surfaces of the sheet.

Figures 13A, 13B, 13C:
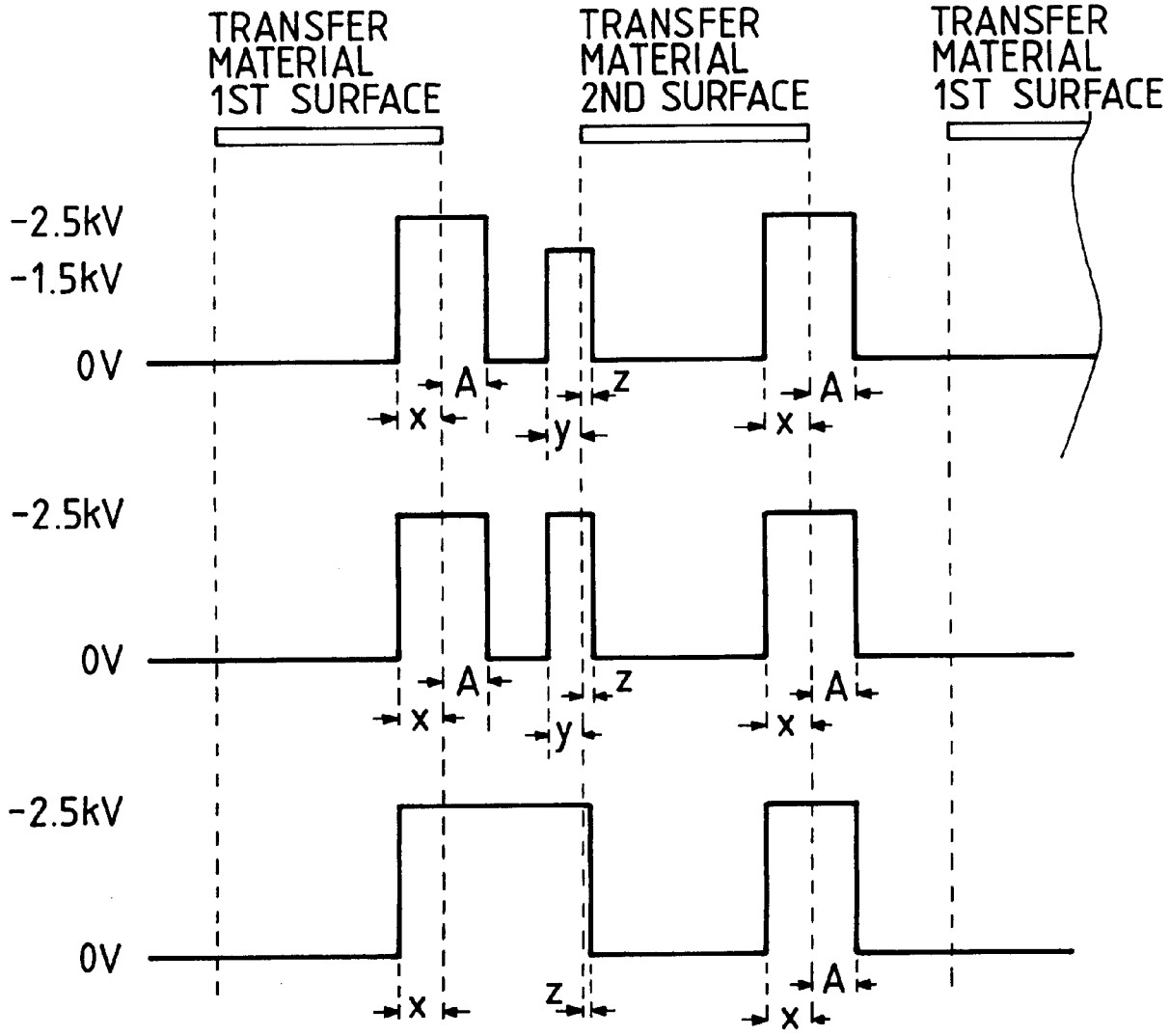
FIGS. 13A to 13C are sequence charts showing a sequence for applying voltage to the electricity removing needle according to the second embodiment.

In the both-face image formation mode, since a tip end portion of the second surface of the sheet is curled in the same direction as the rotational direction of the photosensitive drum, it is hard to separate the sheet from the drum under the curvature separation action. FIGS. 13A to 13C show sequences for applying the voltage to the electricity removing needle to prevent the formation of curvature in the sheet and to prevent the "transfer void" under the high humidity condition.

FIG. 13A shows a fundamental or base sequence in which the potential of −2.5 kV is applied to the electricity removing needle regarding a trail end area of the first surface of the sheet as is in the first embodiment. However, regarding a tip end portion of the second surface of the sheet, the potential of −1.5 kV (required for the sheet separation) is applied to the electricity removing needle. In this way, even if the tip end portion of the second surface of the sheet is curled, since the electrostatic separating action of the electricity removing needle can be improved, the sheet can be separated positively. Incidentally, regarding a central area of the transfer sheet, the potential of the electricity removing needle is maintained to 0 V.

The timing y for changing the potential from 0 V to −1.5 kV is when the tip end of the sheet leaves the transfer nip. More particularly, in consideration of the rise of the electricity removing needle 9, the ON timing y is determined by the following equation:

$$y=L-(\tfrac{1}{2}\times n)+p\times t \text{ (mm)}.$$

Where, L is a distance between the transfer nip and the electricity removing needle, n is a width of the nip, p is a sheet conveying speed and t is a rising time of the power source.

Regarding the OFF timing z for making the potential applied to the electricity removing needle 0 V, it is not necessary to consider the transfer void since the transfer void does not occur under the high humidity condition because the sheet has already been passed through the fixing device. However, regarding the fixing offset, the OFF timing should have a duration sufficient to prevent the influence upon the image. Preferably, the OFF timing has a duration corresponding to a length of a tip end margin of the sheet not to overlap with the image on the sheet. In the illustrated embodiment, since the length of the tip end margin is 5 mm, the OFF timing z is also 5 mm.

In order to separate the tip end of the second surface of the sheet from the drum, a sequence shown in FIG. 13B or a sequence shown in FIG. 13C may be used. Regarding FIG. 13B, unlike FIG. 13A having three potential levels, only two potential levels (0 V and −2.5 kV) are used so that the potential level greater than 0 V is applied to the electricity removing needle regarding the trail end area of the first surface of the sheet and the tip end area of the second surface of the sheet. Regarding FIG. 13C, by maintaining the potential of the electricity removing needle to −2.5 kV during the duration from when the first surface of the sheet leaves the needle to when the tip end of the second surface of the sheet reaches the needle, the number of ON/OFF switching operations is reduced, thereby reducing the number of considerations regarding the rising feature of the power source for the electricity removing needle. That is to say, the sequence shown in FIG. 13B serves to make the power source and associated driving means cheaper, and the sequence shown in FIG. 13C serves to reduce the load acting on the power source and associated driving means in case of a high speed image forming apparatus.

Incidentally, in this embodiment, since an example in which the curvature separating ability is reduced or worsened due to the formation of the curl in the second surface of the sheet was explained, the great potential level was applied to the electricity removing needle regarding the tip end area of the second surface of the sheet. However, by applying the great potential level to the electricity removing needle regarding the tip end area of the first surface of the sheet, a sheet having small resiliency (such as a sheet having a weight of 60 g/m$^2$ or less) can be separated from the drum.

Third embodiment

Figure 14:
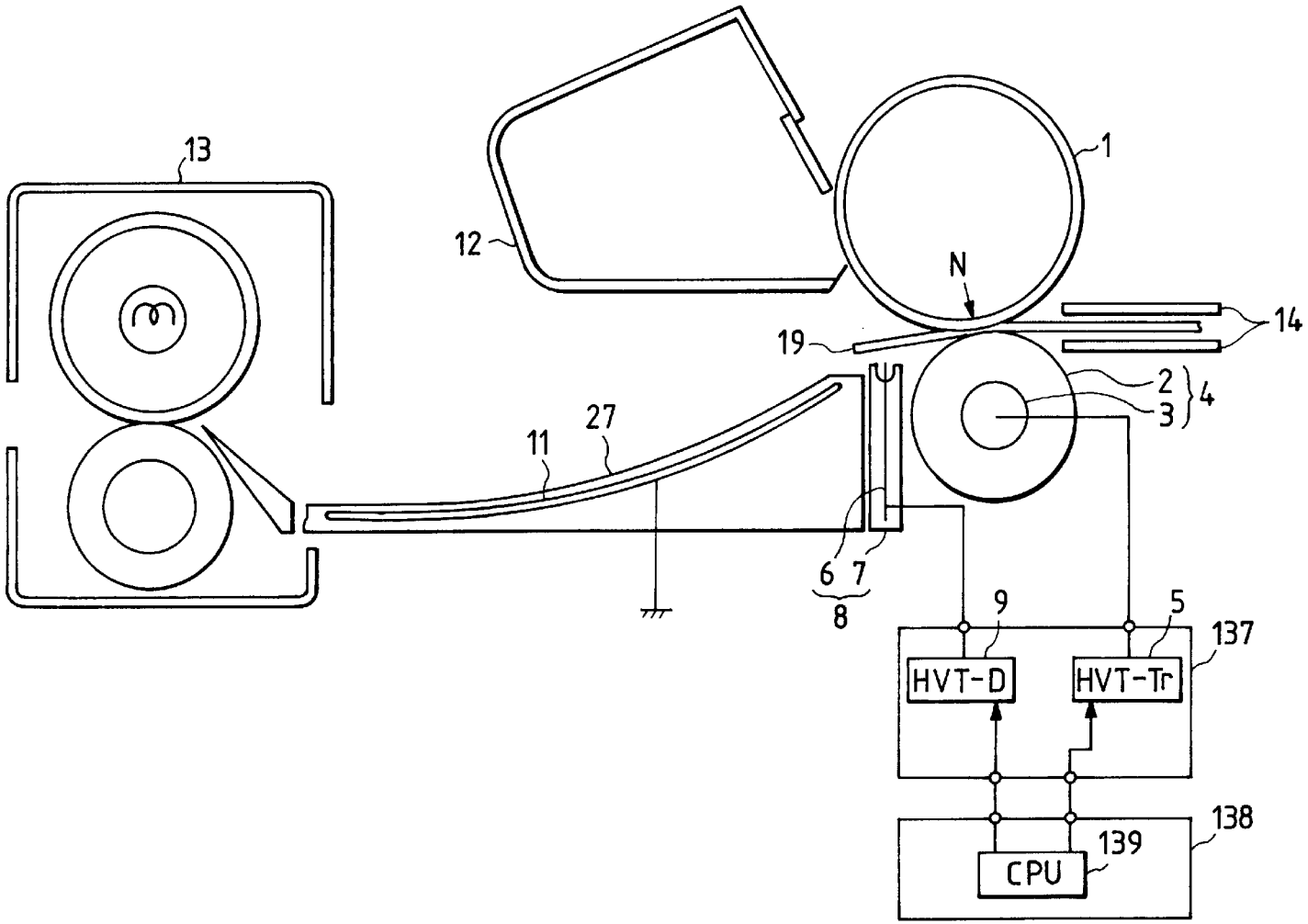
FIG. 14 is a schematic illustration showing an image forming apparatus according to a third embodiment of the present invention.

FIG. 14 shows an image forming apparatus according to a third embodiment of the present invention. Incidentally, the same elements as those in the first and second embodiments are designated by the same reference numerals and detailed explanation thereof will be omitted. This third embodiment shows an example in which a convey guide for guiding the transfer sheet (transfer material) after transferring and before fixing, has a conductive member for absorbing the sheet.

As shown in FIG. 14, the convey guide comprises a plurality of electrically insulation resin ribs 27, and earthed metal plates 11. The voltage from the power source 9 is applied to the electricity removing needle 6, which voltage is controlled by the control portion 138 including the CPU 139 and the like.

Figure 15:
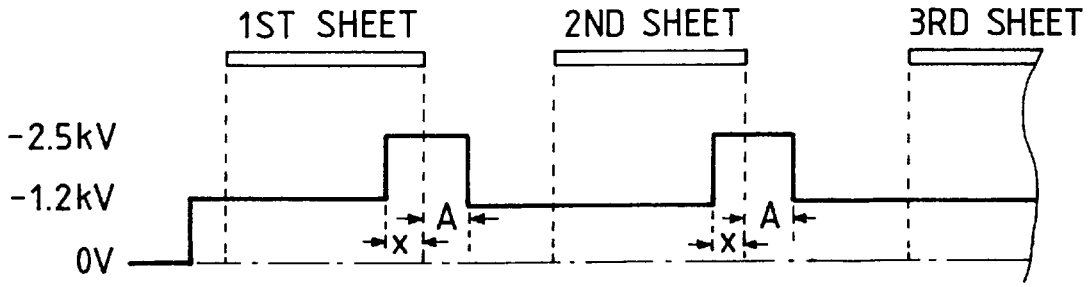
FIGS. 15 and 16 are sequence charts showing a sequence for applying voltage to the electricity removing needle according to the third embodiment.
Figure 16:
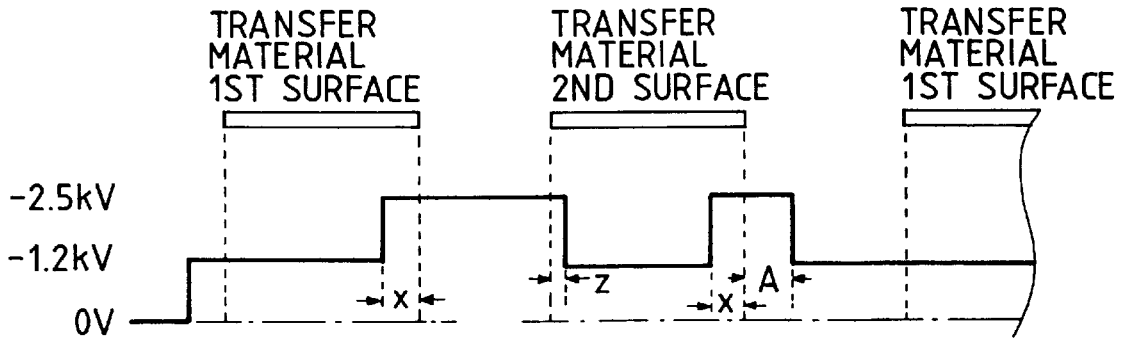

Sequences for applying the potential to the electricity removing needle are shown in FIGS. 15 and 16.

FIG. 15 shows the case where the image is formed on the single surface of the sheet (one-face image formation mode). In this case, the potential applied to the electricity removing needle is maintained to −1.2 kV from the tip end of the sheet to the vicinity of the trail end of the sheet so that the sheet is prevented from being absorbed to the convey guide electrostatically, thereby preventing a sheet jam due to the sheet absorption. On the other hand, regarding the trail end area of the sheet, the potential of −2.5 kV is applied to the electricity removing needle to prevent the occurrence of the "trail end splash".

FIG. 16 shows the case where the images are formed on both surfaces of the sheet (both-face image formation mode). In this case, the potential of −2.5 kV is applied to the electricity removing needle regarding the trail end areas of the first and second surfaces of the sheet and the tip end area of the second surface of the sheet, thereby preventing adhesion of the sheet to the convey guide. In the both-face image formation mode, the timing for switching the potential applied to the electricity removing needle between the trail end area of the first surface of the sheet and the tip end area of the second surface of the sheet is the same as the switching timing in the second embodiment.

With the arrangement as mentioned above, even when the conductive absorption member is provided in the convey guide, it is possible to prevent the poor image due to the "trail end splash" and the sheet jam due to the poor separation of the tip end of the sheet, as well as the sheet jam due to the adhesion of the sheet.

Incidentally, in this third embodiment, while an example in which the potential of −1.2 kV is applied to the electricity removing needle regarding the central areas of the first and second surfaces of the sheet was explained, the value of the potential may be changed depending upon the image and/or sheet convey feature. Further, in the illustrated embodiment, regarding the switching of the voltage value applied to the electricity removing needle, while an example in which the voltage value is immediately changed (in a digital fashion) was explained, the switching of the voltage value (other than the switching of the voltage from the low voltage to the high voltage regarding the trail end area of the sheet) may be effected in an analog fashion or with a certain time constant.

Further, in the illustrated embodiment, in the both-face image formation mode, the voltage applied to the electricity removing needle is maintained at −2.5 kV while the sheet is not passed above the electricity removing needle 6. However, in this case, since the great voltage is applied to the electricity removing needle while the sheet is not passed above the electricity removing needle, there is a danger of charging the photosensitive drum by the electricity removing needle. When a charge roller (not shown) such as a first charge (for charging the photosensitive drum) having small potential converging ability is used or when the current flowing into the charger is reduced to prevent the occurrence of ozone (i.e., charging ability is decreased), the charged history or record generated by the electricity removing needle cannot often be erased.

Figure 19:
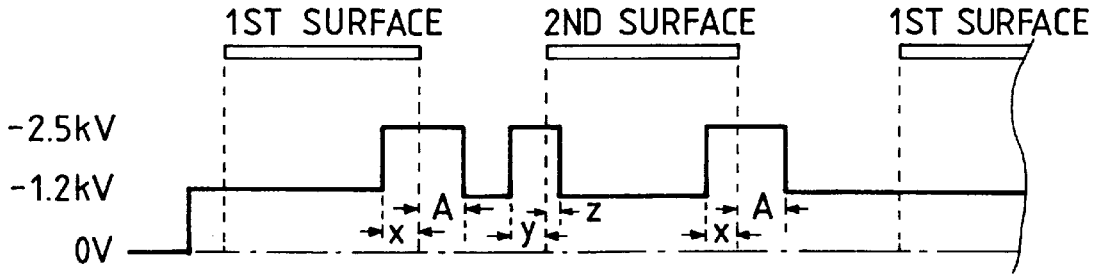
FIGS. 19 to 21 are sequence charts showing a sequence for applying voltage to the electricity removing needle according to the third embodiment.
Figure 20:
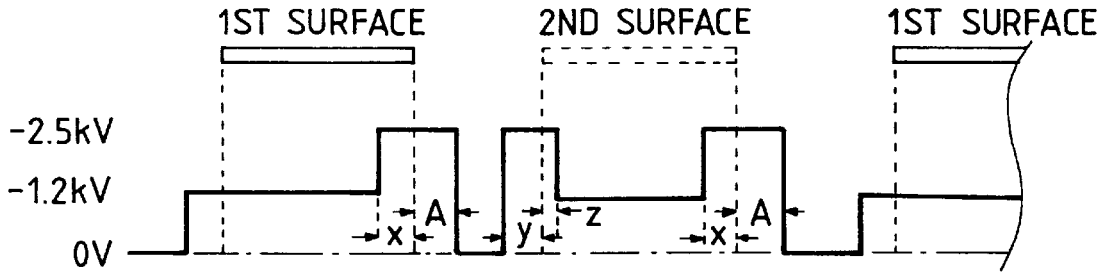
Figure 21:
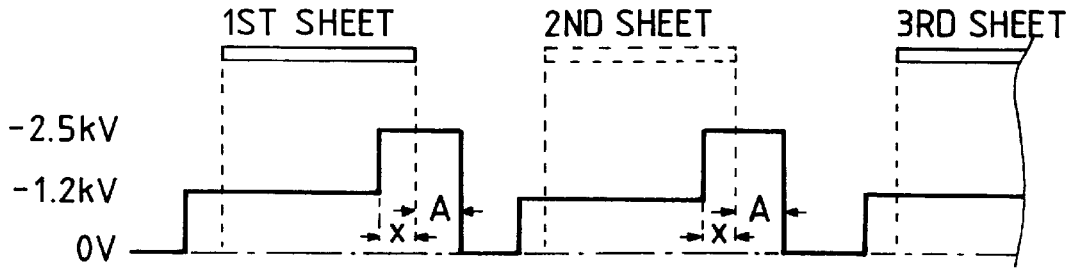

If the charged history of the electricity removing needle remains as it is, since the uniform charging cannot be achieved along a longitudinal direction of the photosensitive drum, the poor image including white stripes will occur. In such a case, as shown in FIG. 19, it is effective when the voltage applied to the electricity removing needle is maintained to −1.2 kV while the sheet is not passed above the electricity removing needle. Further, when the rise of the high voltage source is sufficiently fast under the operating condition of the apparatus, it is effective when the voltage applied to the electricity removing needle is maintained at 0 V while the sheet is not passed above the electricity removing needle, in the one-face image formation mode (FIG. 20) and in the both-face image formation mode (FIG. 21).

Fourth embodiment

Figure 23:
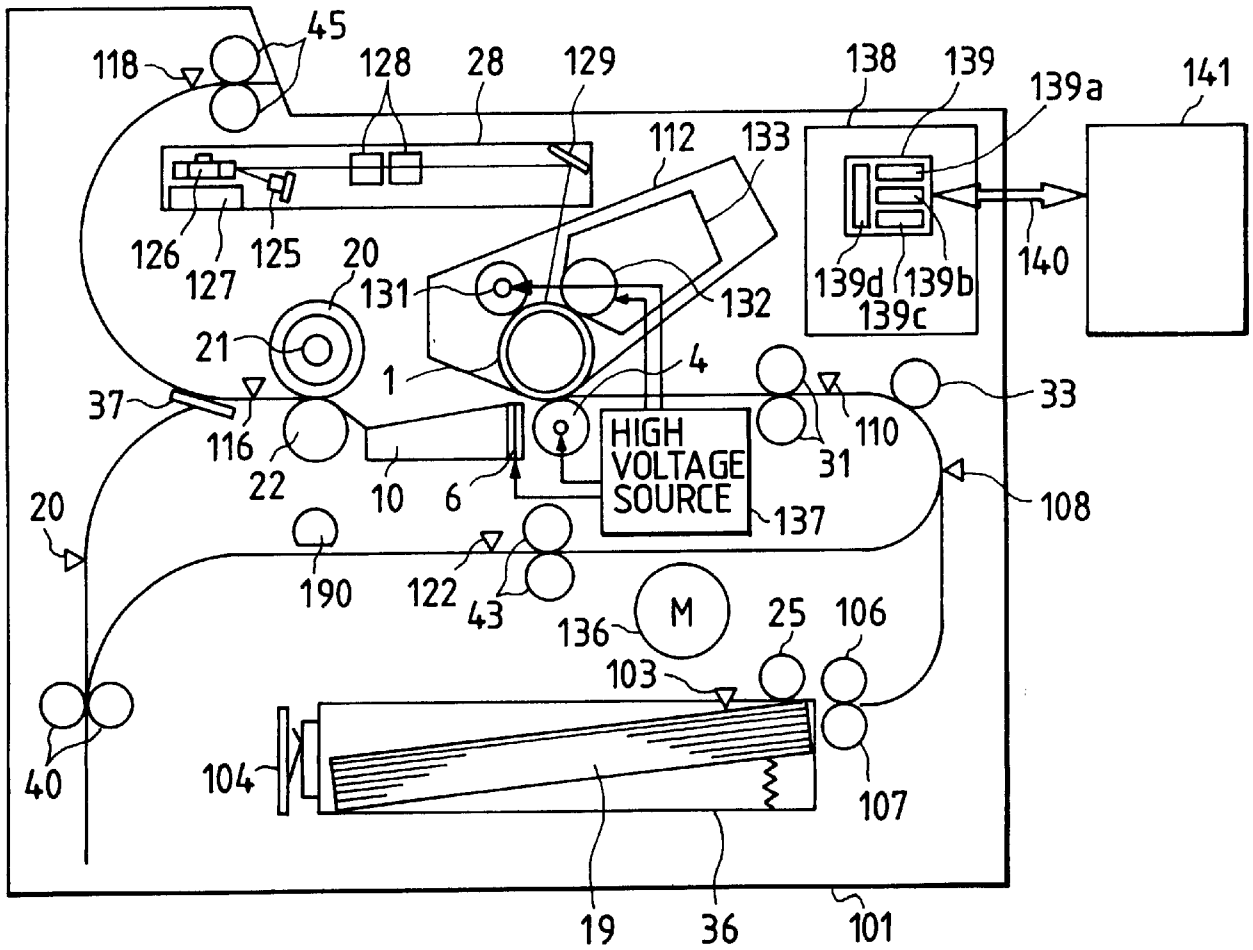
FIG. 23 is an elevational sectional view of a laser printer according to the fourth embodiment.

Now, an image forming apparatus according to a fourth embodiment of the present invention will be explained. FIG. 23 shows a laser printer 101 according to the fourth embodiment. The laser printer 101 includes a deck 36 containing recording sheets (transfer sheets) 19 therein, a deck sheet presence/absence sensor 103 for detecting presence/absence of the sheet 19 in the deck 36, a sheet size detection sensor 104 (constituted by a plurality of micro-switches which will be described later) for detecting a size of the transfer sheet 19 contained in the deck 36, a pick-up roller 25 for picking up the sheet(s) 19 from the deck 36, a deck sheet supply roller 106 for conveying the sheet(s) 19 picked up from the deck by the pick-up roller 25, and a retard roller 107 associated with the deck sheet supply roller 106 to prevent the double-feed of sheets.

At a downstream side of the deck sheet supply roller 106, there are disposed a sheet supply sensor 108 for detecting a sheet conveying condition from a both-face reverse rotation portion (described later), a sheet supply convey roller 33 for further conveying the transfer sheet 19 in a downstream direction, a pair of regist rollers 31 for conveying the transfer sheet 19 in synchronous with the photosensitive drum 1, and a pre-regist sensor 110 for detecting a conveying condition of the sheet 19 to the paired regist rollers 31. Further, at a downstream side of the pair of regist rollers 31, there are disposed a process cartridge 112 for forming a toner image on the photosensitive drum 1 on the basis of a laser beam from a laser scanner portion 28 (described later), a roller member (referred to as "transfer roller" hereinafter) 4 for transferring the toner image formed on the photosensitive drum 1 onto the transfer sheet 19, and a discharge member (referred to as "electricity removing needle" hereinafter) 6 for removing the charge from the transfer sheet 19 and promoting the separation of the sheet from the photosensitive drum 1.

Further, at a downstream side of the electricity removing needle 6, there are disposed a convey guide 10, a fixing portion including a fixing roller 20 having a heating halogen heater therein for thermally fixing the toner image to the transfer sheet 19 and a pressure roller 22 urged against the fixing roller, a fixing sheet discharge sensor 116 for detecting a conveying condition of the sheet from the fixing portion, and a both-face flapper 37 for switching a sheet path between a sheet discharge portion and a both-face reverse rotation portion. At a downstream side of the sheet discharge portion, there are disposed a sheet discharge sensor 118 for detecting a sheet conveying condition from the sheet discharge portion, and a pair of sheet discharge rollers 45 for discharging the transfer sheet 19.

On the other hand, in order to form the images on both surfaces of the sheet, the both-face reverse rotation portion for reversing (i.e., turning over) the sheet having one surface on which the image was formed and for re-supplying the sheet to the image forming portion again includes a pair of reverse rotation rollers 40 for switching-back the transfer sheet 19 by normal/reverse rotation thereof, a D-cut roller 190 for conveying the transfer sheet 19 from a lateral regist portion (not shown) where a lateral position of the sheet is determined, a both-face sensor 122 for detecting a sheet conveying condition from the both-face reverse rotation portion, and a pair of both-face convey rollers 43 for conveying the transfer sheet 19 from the both-face reverse rotation portion to a sheet supply portion.

Further, the scanner portion 28 comprises a laser unit 125 for emitting a laser beam modulated in response to an image signal sent from an external device 141 (described later), a polygon mirror 126 and a scanner motor 127 for scanning the photosensitive drum 1 with the laser beam from the laser unit 125, a group of lenses 128, and a reflection mirror 129.

The process cartridge 112 includes the photosensitive drum 1, a first charger 131, a developing sleeve 132 and a toner containing container 133 which are required for effecting the known electrophotographic process, which process cartridge can be removably mounted on the laser printer. A high voltage source 137 serves to supply desired voltage to the first charger 131, developing sleeve 132, transfer roller 4 and electricity removing needle 6. A main motor 136 serves to supply a driving force to various elements. Further, a printer control portion 139 for controlling the laser printer 101 comprises an MPU (microcomputer) 139 including a RAM 139*a*, a ROM 139*b*, a timer 139*c* and an I/O (input/output) portion 139*d*, and various I/O control circuits (not shown).

The printer control portion 139 is connected to the external device 141 such as a personal computer through an interface 140. A synchronous signal (referred to as "VSYNC signal" hereinafter) of an image output (described later) in a vertical direction is also sent from the external device 141 to the printer control portion 139 through the interface 140.

Figure 22:
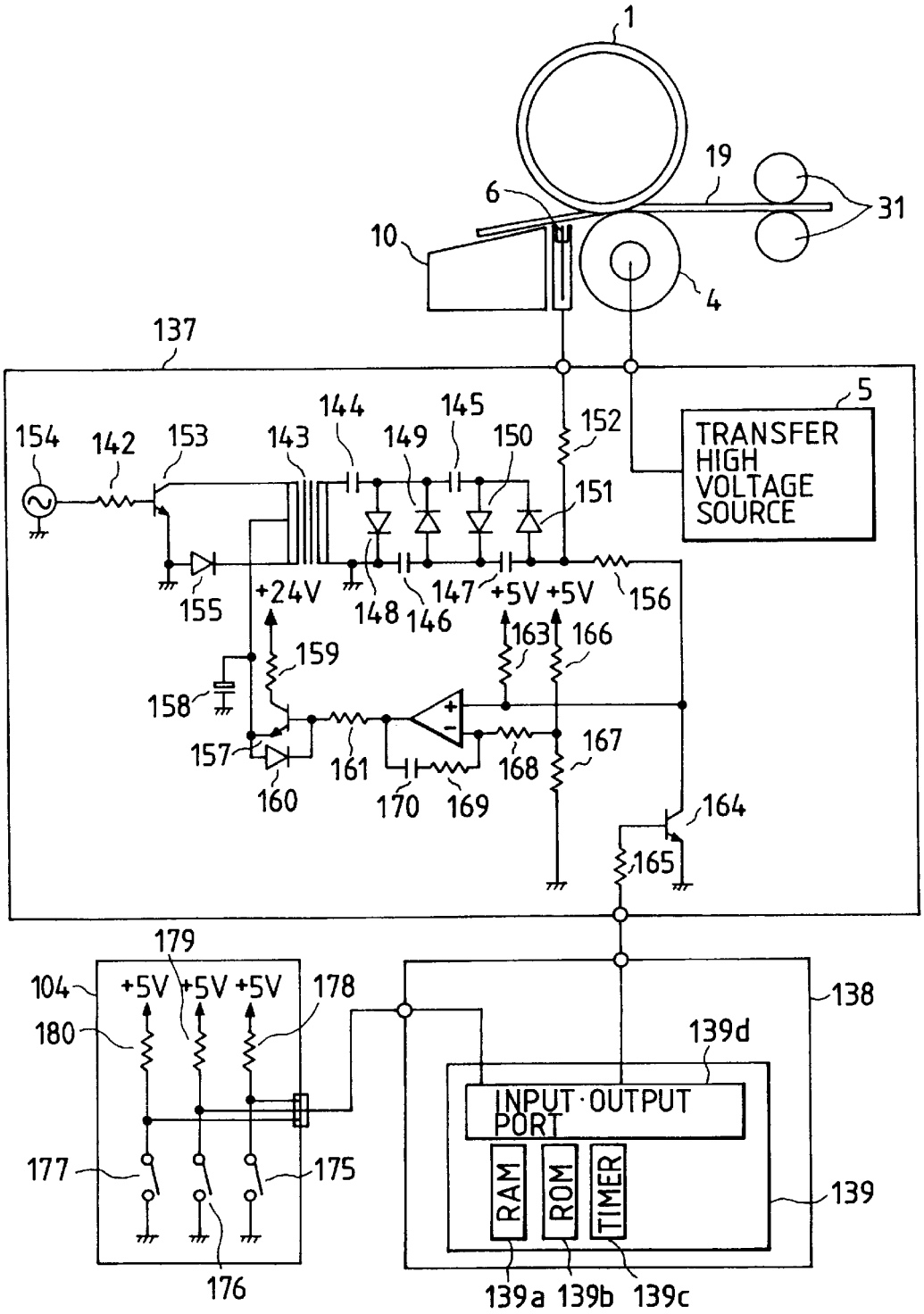
FIG. 22 is a circuit diagram of a high voltage power source for an electricity removing needle according to a fourth embodiment of the present invention.

FIG. 22 is a circuit diagram of the high voltage source for the electricity removing needle and therearound. The high voltage for the electricity removing needle is obtained by voltage-doubling AC voltage generated at an output terminal of an inverter transformer 143 by four times by diodes (148–151) and capacitors (144–147), and is supplied to the electricity removing needle through a shorting protection resistor 152. The output voltage of the electricity removing needle is voltage-divided and detected by a resistor 156 and a resistor 163, and the input voltage of the inverter transformer 143 is controlled by a power amplifier comprised of resistors (159, 161), a transistor 157, an aluminium electrolytic capacitor 158 and a protection diode 160 so that the input voltage is equalized to reference voltage inputted to positive and negative terminal of an operation amplifier 162. The reference voltage is obtained by voltage-dividing +5 V by resistors (166–168). A resistor 169 and a capacitor 170, together with the above-mentioned composite resistor comprised of the resistors (166–168), constitute an overshoot control circuit for the electricity removing needle.

Figure 35:
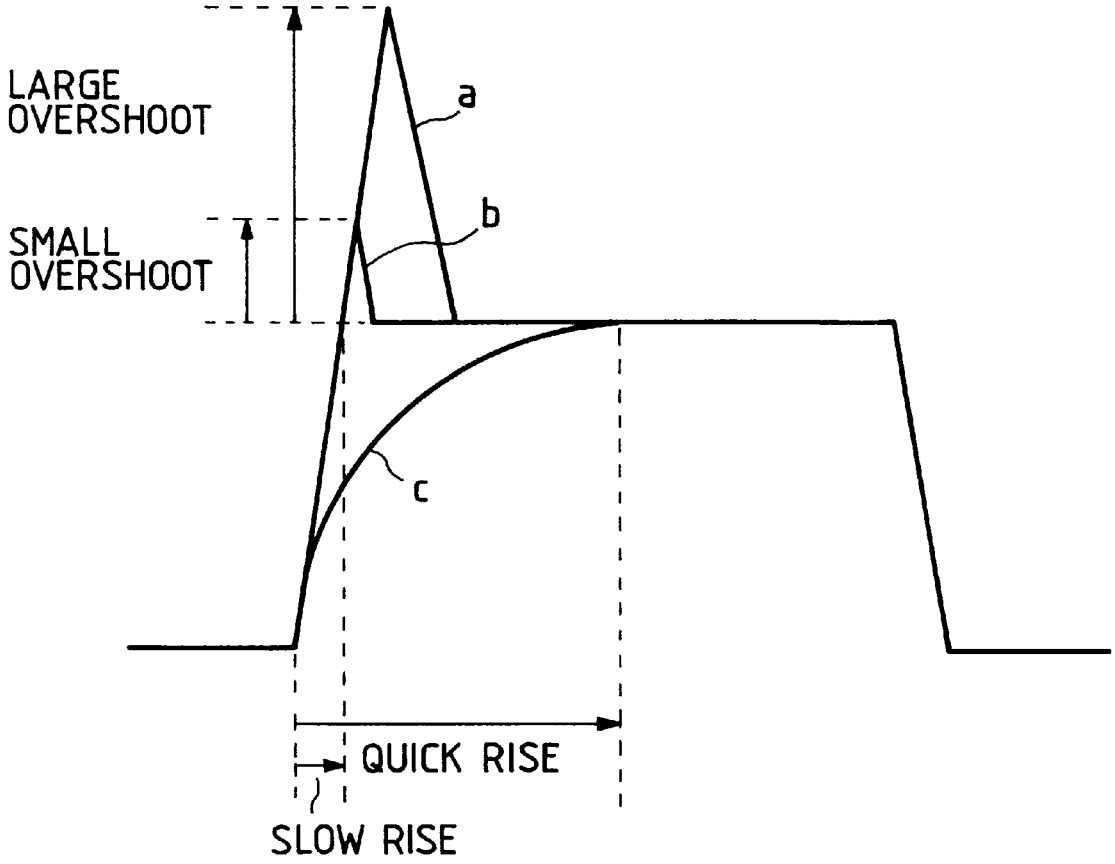
FIG. 35 is a view showing a rising wave form of the electricity removing needle.

FIG. 35 shows a rising wave form of the high voltage of the electricity removing needle. In FIG. 35, a curve a indicates a wave form when the resistor 169 and capacitor 170 are not provided. In this case, since there is no feed-back from the output of the operation amplifier 162 to the reference voltage side, the wave form has quick rise but has large overshoot. A curve c in FIG. 35 indicates a wave form when the value of the resistor 169 is small and/or the capacity of the capacitor 170 is great. In this case, the wave form has no overshoot but has slow rise. In the illustrated embodiment, as shown by a curve b in FIG. 35, the value of the resistor 160, the capacity of the capacitor and the resistance value of the composite resistor are selected so that a wave form has moderate rise and does not include the excessive overshoot as is in the wave form a.

A transistor 153 for driving the inverter transformer 143 has a base connected to an oscillation circuit 154 through a resistor 142. A diode 155 constitutes a snapper circuit. Further, a transistor 164 serves to effect ON/OFF of the high voltage of the electricity removing needle and has a base connected to the I/O port 139*d* of the MPU 139 of the printer control portion 138 through a resistor 165. If a level of the connected port is HIGH, the transistor 164 is turned ON, with the result that the positive terminal of the operation amplifier 162 becomes ground potential level, thereby changing the high voltage of the electricity removing needle to an OFF condition. On the other hand, if the level of the connected port is LOW, the transistor 164 is turned OFF, with the result that the high voltage of the electricity removing needle is outputted. A transfer high voltage source 174 serves to supply high voltage to the transfer roller 4.

The sheet size detection sensor 104 is constituted by micro-switches (175–177) and resistors (178–180). A level of the I/O port connected to the depressed micro-switch becomes LOW, and a level of the I/O port connected to the non-depressed micro-switch becomes HIGH. Thus, by combination of HIGH/LOW of three ports, the size of the transfer sheet 19 being printed can be detected, thereby controlling the output timing of the high voltage of the electricity removing needle which will be described later.

Figure 24:
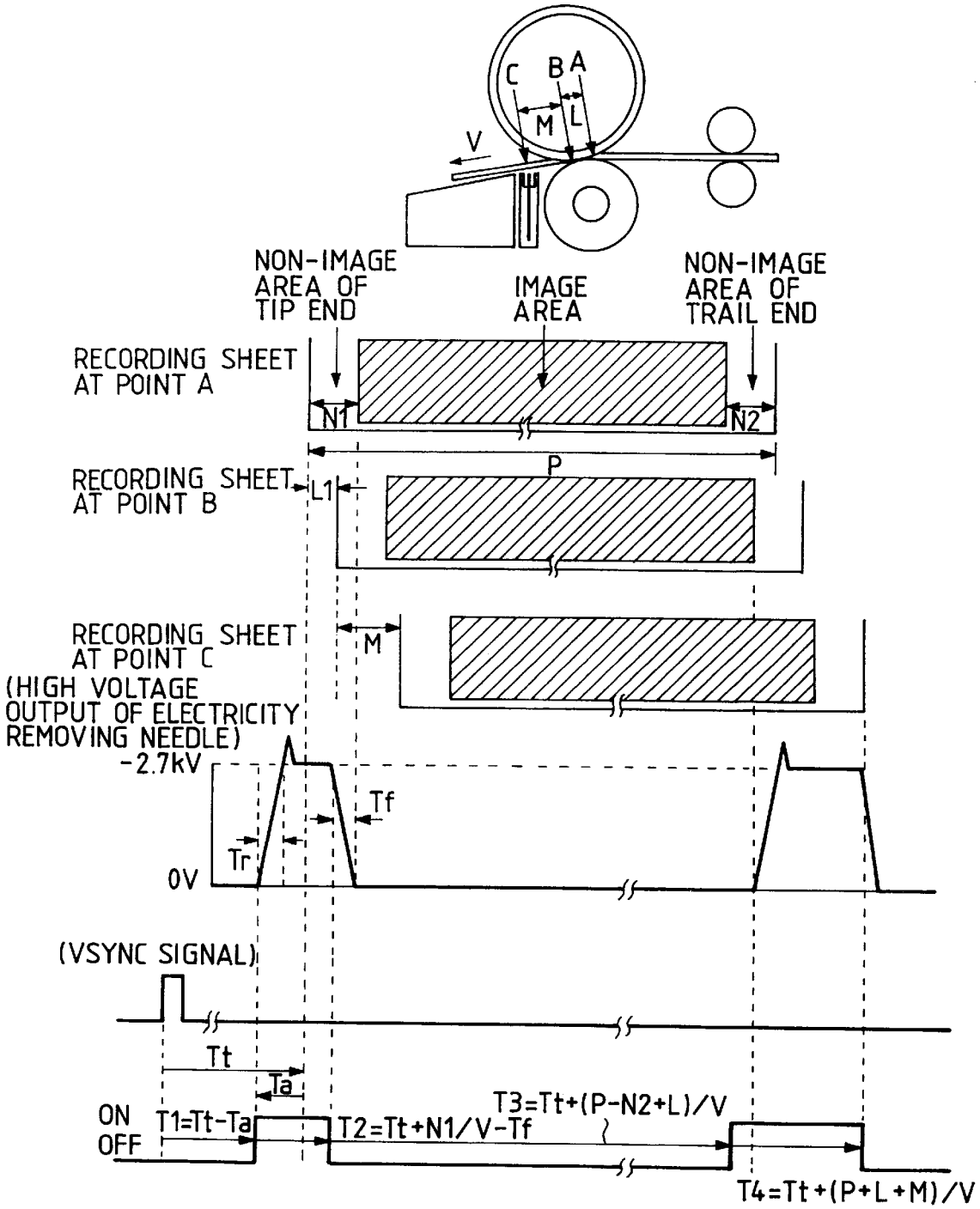
FIG. 24 is a timing chart according to the fourth embodiment.

FIG. 24 is a timing chart according to the illustrated embodiment. In FIG. 24, a point A indicates an upstream end of the nip between the photosensitive drum 1 and the transfer roller 4, a point B indicates a downstream end of said nip and a point C indicates a position immediately above the electricity removing needle 6. A distance between the points A and B is L1 (mm) and a distance between the points B and C is M (mm). The transfer sheet (recording sheet) is conveyed through these three points at a speed of V (mm/sec). A width of a non-image area of the tip end of the recording sheet 19 is N1 (mm), a width of a non-image area of the trail end of the recording sheet 19 is N2 (mm) and a length of the recording sheet is P (mm). The length of the recording sheet is detected on the basis of a signal from the sheet size detection sensor 104.

First of all, the drive signal for the high voltage of the electricity removing needle (I/O port connected to the base of the transistor 164) is turned ON after a time T1 (sec) has elapsed from a rising edge of the VSYNC signal, thereby rising the high voltage of the electricity removing needle to −2.7 kV before the tip end of the recording sheet reaches the point A. The time T1 (sec) is the time duration obtained by subtracting a time Ta (sec) greater than the rising time Tr (sec) of the high voltage of the electricity removing needle from a time Tt (sec) when the tip end of the recording sheet reaches the point A from the emission of the VSYNC signal. That is to say:

$$T1=Tt-Ta(Ta>Tr).$$

Then, the drive signal is turned OFF after a time T2 (sec) so that the high voltage of the electricity removing needle becomes 0 V before the image area of the recording sheet 19 reaches the nip. The time T2 is time duration obtained by subtracting the falling time Tf (sec) of the high voltage of the electricity removing needle from a time (Tt+N1/V) (sec) when the image area reaches the point A. That is to say:

$$T2=Tt+(n1/V)-Tf.$$

If the high voltage is applied to the electricity removing needle in a condition in which the image area exists in the nip, when the laser printer is used under the high humidity condition, the current flowing onto the recording sheet (as charges) from the transfer roller 4 to effect the transferring of the toner image cannot be held on the recording sheet 19 due to the reduction of resistance of the recording sheet 19 to escape to the electricity removing needle, thereby causing the so-called "transfer void". The reason for setting the above times is to prevent the occurrence of the transfer void. The control for the high voltage of the electricity removing needle regarding the trail end of the recording sheet 19 is effected in the similar manner.

In the trail end area of the recording sheet 19, the high voltage is applied to the electricity removing needle at a timing T3 (sec) when the image area leaves the nip. That is to say:

$$T3=Tt+(P-N2+L)/V.$$

And, the high voltage of the electricity removing needle is turned OFF at a timing T4 (sec) when the trail end of the recording sheet leaves the point C. That is to say:

$$T4=Tt+(P+L+M)/V.$$

Figure 25:
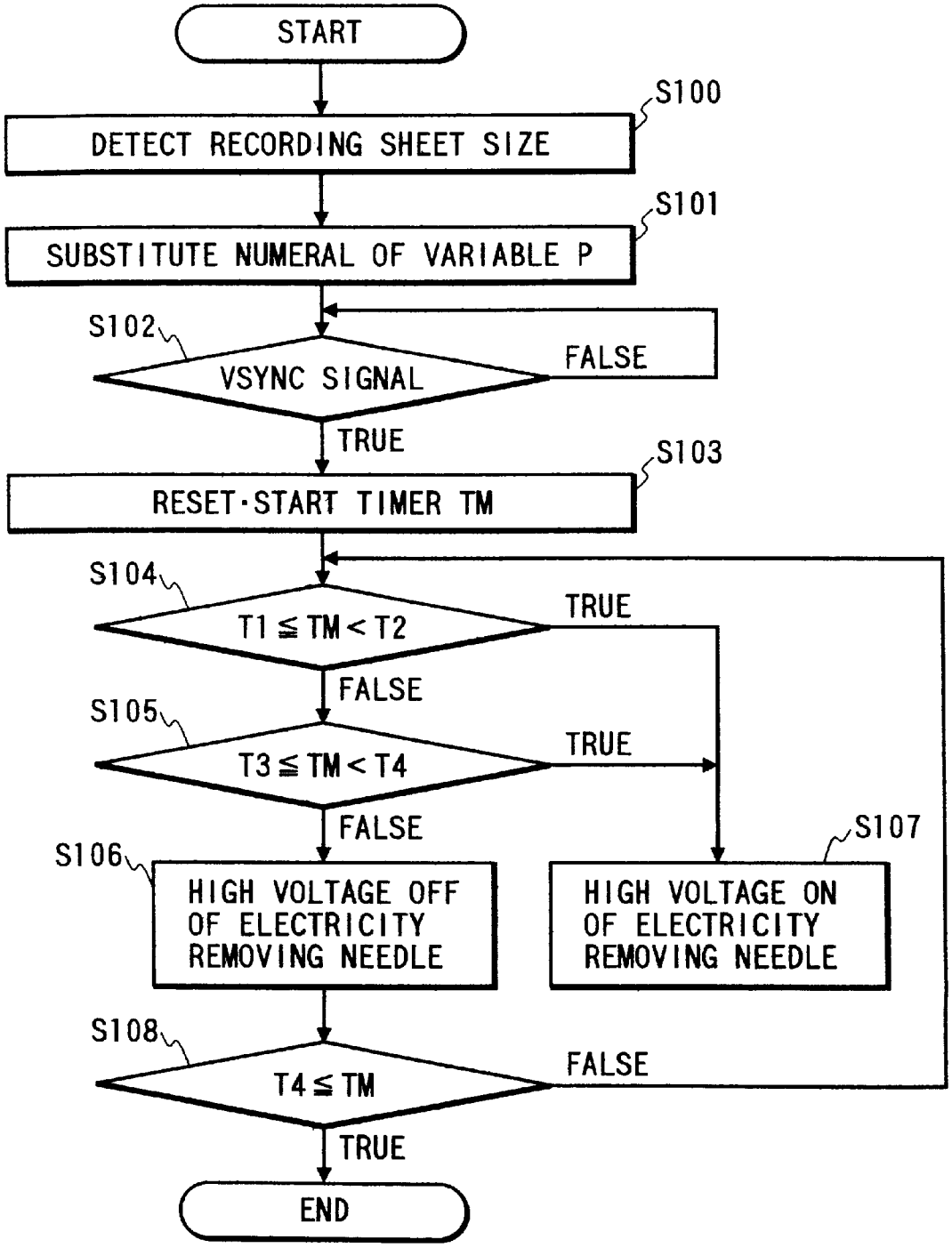
FIG. 25 is a flowchart according to the fourth embodiment.

FIG. 25 is a flowchart showing the control according to the illustrated embodiment. First of all, the size of the recording sheet is detected by the sheet size detection sensor 104 (step S100), and the variable P is substituted for a numeral on the basis of a sheet size detection result to calculate the timing T3 (sec) and the timing T4 (sec) (step S101). After a waiting condition is maintained until the VSYNC signal becomes "True" (step S102), a timer TM is reset and a counter is started (step S103). If the timer TM is T1≦TM<T2 (step S104) or T3≦TM<T4 (step S105), the high voltage of the electricity removing needle is turned ON (step S107); otherwise, the high voltage of the electricity removing needle is turned OFF (step S106). If the timer TM is T4≦TM, the control is finished (step S108).

In this way, since the high voltage applied to the electricity removing needle is made variable between the image area and the non-image areas of the recording sheet and the absolute value of the applied voltage regarding the non-image area (−2.7 kV) becomes greater than the absolute value of the applied voltage regarding the image area (0 V), the charge can be fully removed from the tip end of the recording sheet to separate the tip end from the photosensitive drum effectively, and the charge can be forcibly removed from the trail end area of the recording sheet so that the electrostatic force for holding the toner on the recording sheet can be maintained and the "trail end splash" for moving the trail end of the sheet together with the photosensitive drum can be prevented.

Fifth embodiment

Figure 26:
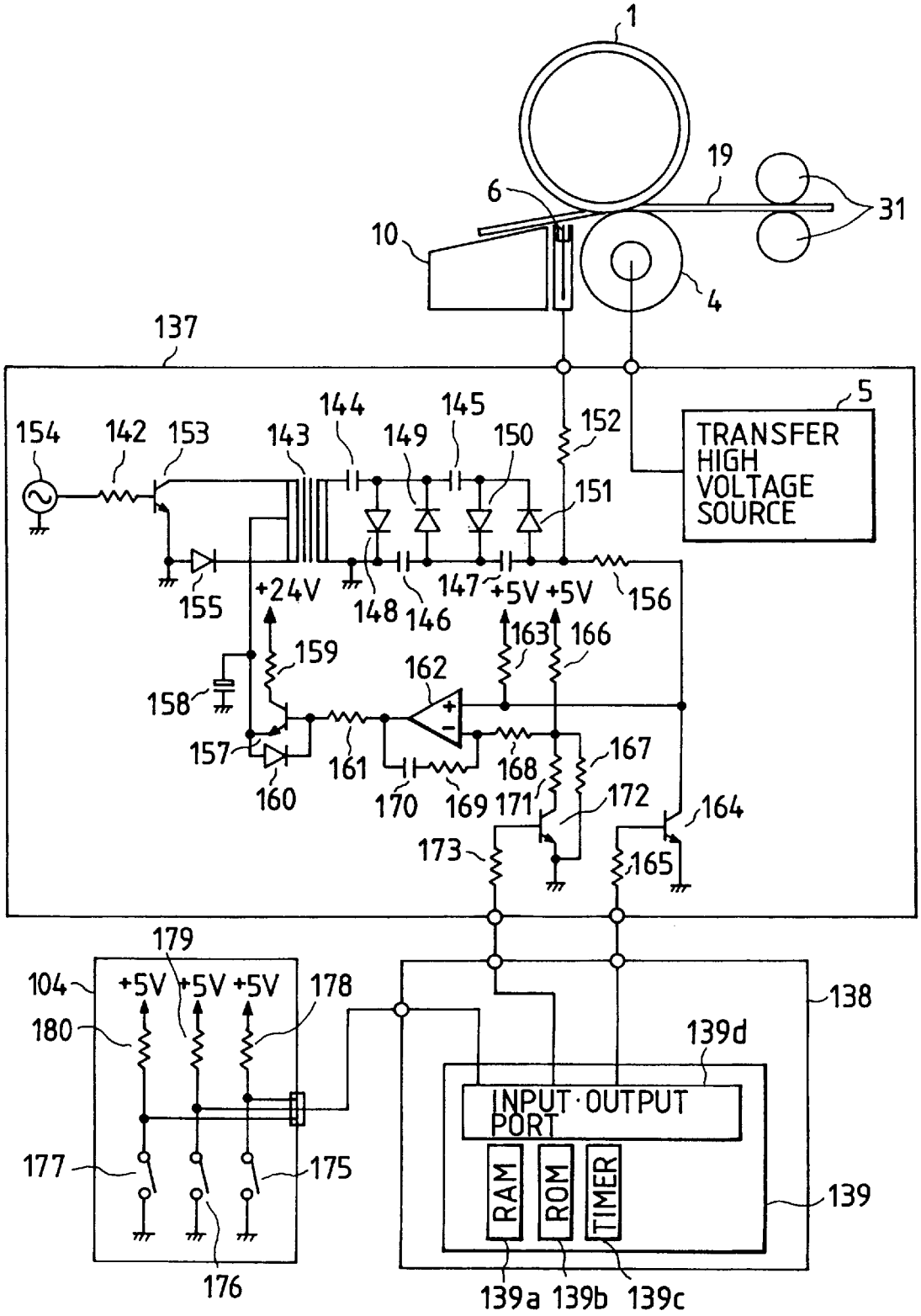
FIG. 26 is a circuit diagram of a high voltage power source for an electricity removing needle according to a fifth embodiment of the present invention.

Next, a fifth embodiment of the present invention will be explained with reference to FIG. 26 showing a circuit diagram of the high voltage source for the electricity removing needle and therearound. This fifth embodiment differs from the fourth embodiment in that the reference voltage inputted to the negative terminal of the operation amplifier 162 is made variable so that the output value of the high voltage of the electricity removing needle can be changed or switched. When a transistor 172 having a base connected to the I/O port 139*d* of the MPU 139 through a resistor 173 is turned ON (i.e., when the I/O port 139*d* becomes HIGH level), a resistor 171 is connected to a resistor 167 in parallel, thereby decreasing the reference voltage. In the illustrated embodiment, since the high voltage of the electricity removing needle has a minus value, the absolute value of the high voltage output of the electricity removing needle is increased.

Figure 27:
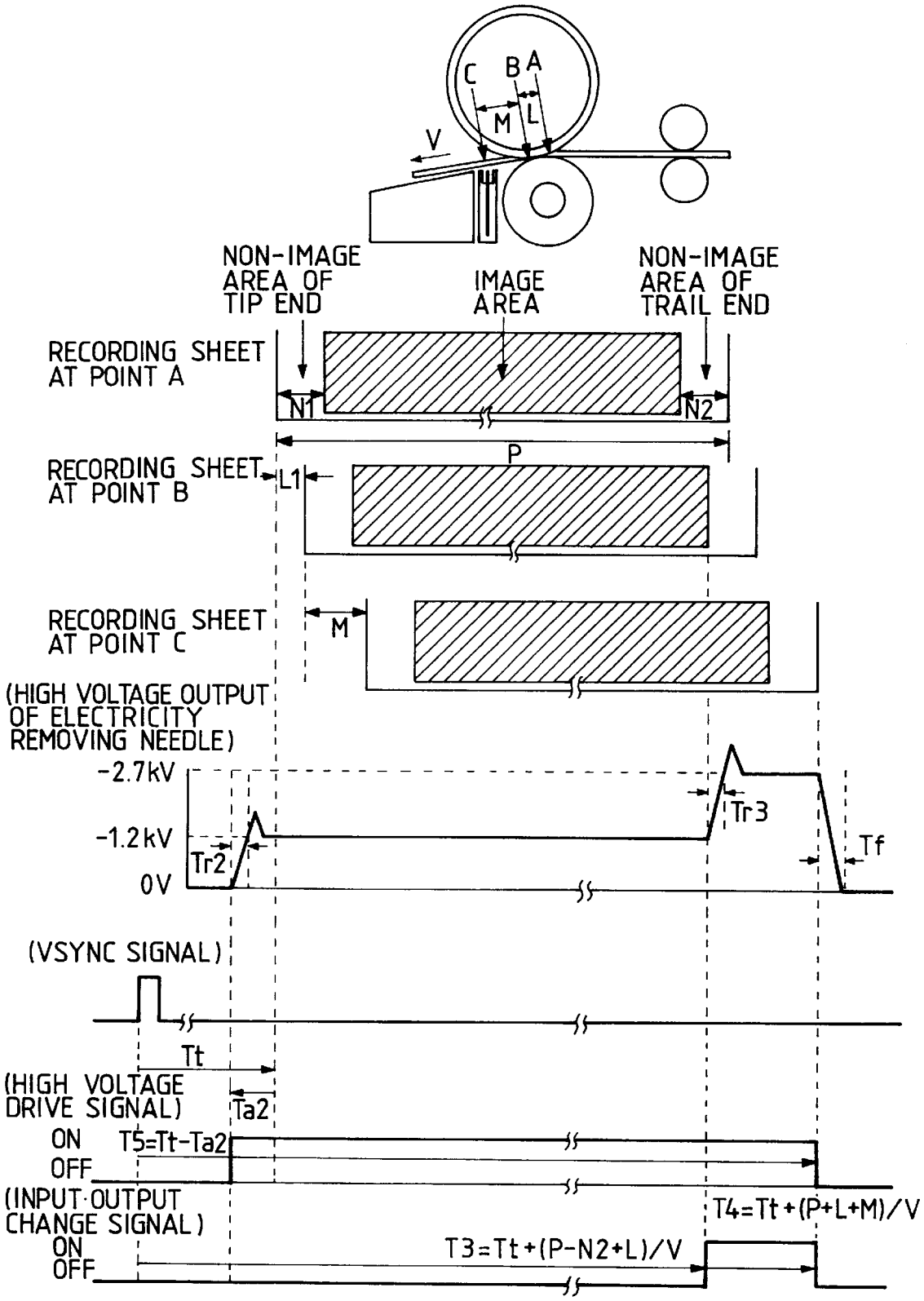
FIG. 27 is a timing chart according to the fifth embodiment.

FIG. 27 is a timing chart according to the illustrated embodiment. First of all, the drive signal for the high voltage of the electricity removing needle has turned ON after a time T5 (sec) is elapsed from a rising edge of the VSYNC signal, thereby rising the high voltage of the electricity removing needle to −1.2 kV before the tip end of the recording sheet 19 reaches the point A. The time T5 (sec) is a time duration obtained by subtracting a time Ta2 (sec) greater than the rising time Tr2 (sec) when the high voltage of the electricity removing needle rises from 0 V to −1.2 kV from a time Tt (sec) when the tip end of the recording sheet 19 reaches the point A from the emission of the VSYNC signal. That is to say:

$$T5=Tt-Ta2(Ta2>Tr2).$$

The high voltage (of the electricity removing needle) of −1.2 kV is voltage sufficient to separate the tip end of the recording sheet 19 from the photosensitive drum 1 while keeping the electrostatic force for holding the toner on the recording sheet 19 and without occurring the transfer void.

Then, the output switching signal is turned ON at the timing T3 (sec) when the image area is leaves the point B, thereby increasing the high voltage of the electricity removing needle to −2.7 kV. And, the high voltage drive signal and the input/output change signal are turned ON at the timing T4 (sec) when the trail end of the recording sheet 19 leaves the point C, thereby turning OFF the high voltage of the electricity removing needle.

Figure 28:
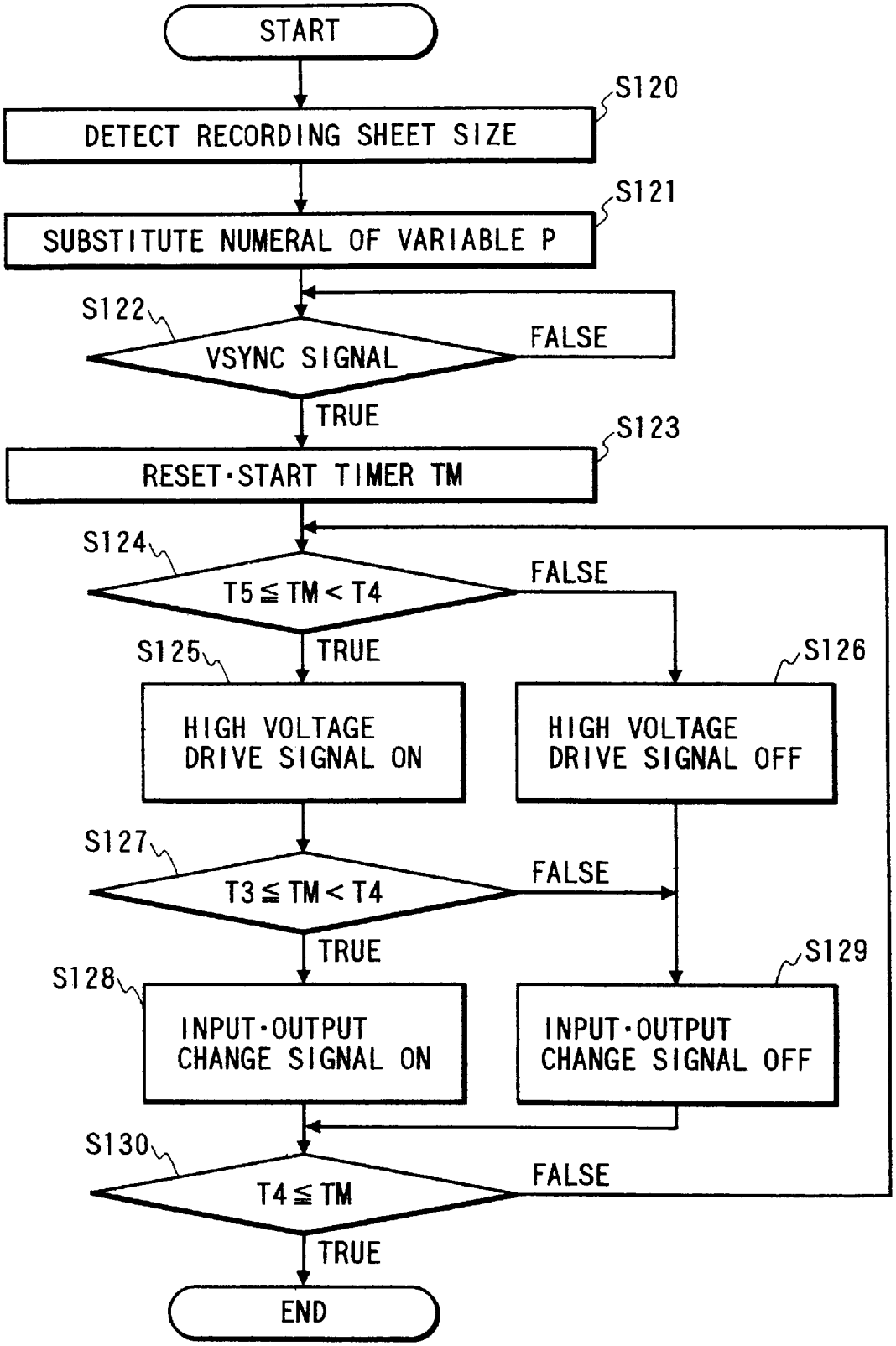
FIG. 28 is a flowchart according to the fifth embodiment.

FIG. 28 is a flowchart showing the control according to the illustrated embodiment. Steps (S120–S123) from START to reset/start of the timer TM are the same as those in the fourth embodiment. Thereafter, if the timer TM is T5≦TM<T4 (True) (step S124), the high voltage drive signal is turned ON; whereas, if the result in the step S124 is False, the high voltage drive signal is turned OFF (step S126). Further, if the timer is T3≦TM<T4 (step S127), the input/output change signal is turned ON (step S128); whereas, if the result in the step S127 is False, the input/output change signal is turned OFF (step S129). And, if the timer is T4≦TM, the control is finished (step S130).

In this way, since the high voltage applied to the electricity removing needle is made to vary between the tip end area and the trail end area of the recording sheet and the absolute value of the applied voltage regarding the trail end area (−2.7 kV) becomes greater than the absolute value of the applied voltage regarding the tip end area (−1.2 kV), the charge can be fully removed from the tip end area of the recording sheet to separate the tip end from the photosensitive drum effectively, and the charge can be forcibly removed from the trail end area of the recording sheet so that the electrostatic force for holding the toner on the recording sheet can be maintained and the "trail end splash" for moving the trail end of the sheet together with the photosensitive drum can be prevented.

Sixth embodiment

Next, a sixth embodiment of the present invention will be explained with reference to the accompanying drawings. A circuit diagram of the high voltage source for the electricity removing needle and therearound is the same as that of the fourth embodiment.

Figure 29:
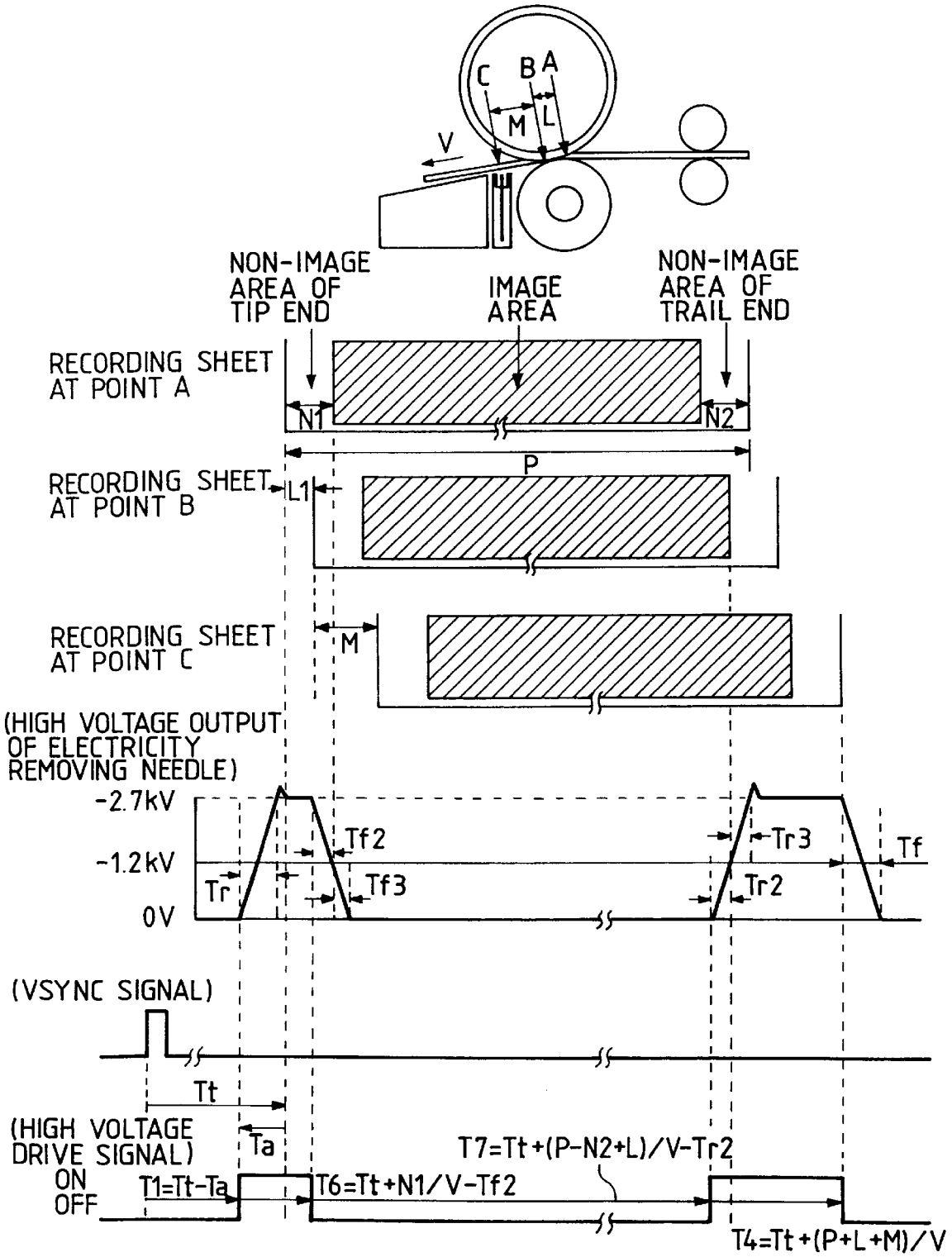
FIG. 29 is a timing chart according to a sixth embodiment of the present invention.

FIG. 29 is a timing chart according to the illustrated embodiment. The fifth embodiment differs from the fourth embodiment in the points that a timing (T6) for falling the high voltage of the electricity removing needle regarding the tip end area of the recording sheet 19 (T2 in the fourth embodiment) is delayed so that the high voltage of the electricity removing needle becomes −1.2 kV or less until the image area of the recording sheet reaches the point A, and that a timing (T7) for rising the high voltage of the electricity removing needle regarding the trail end area of the recording sheet 19 (T3 in the fourth embodiment) is fastened so that the high voltage of the electricity removing needle is maintained below −1.2 kV until the image area of the recording sheet leaves the point B. That is to say, the timing T6 and the timing T7 are defined by the following equations:

$$T6 = T2 + Tf3$$

$$= Tt + N1/V - Tf + Tf3 \text{ (since } T2 = N1/V - Tf\text{)}$$

$$= Tt + N1/V - Tf2 \text{ (since } Tf = Tf2 + Tf3\text{); and}$$

$$T7 = T3 - Tr2$$

$$= Tt + (P - N2 + L)/V - Tr2$$

$$\text{(since } T3 = Tt + (P - N2 + L)/V\text{).}$$

The reason why the condition that the high voltage of the electricity removing needle is maintained below −1.2 kV so long as the image area of the recording sheet exists in the nip is to prevent the occurrence of the transfer void as is in the fifth embodiment.

A flowchart for effecting the control according to the illustrated embodiment is the same as that of the fourth embodiment shown in FIG. 25, except that T2 is changed to T6 and T3 is changed to T7.

In this way, since the fall starting timing of the high voltage of the electricity removing needle is delayed and the rise starting timing of the high voltage of the electricity removing needle is fastened so that the voltage applied to the electricity removing needle is maintained to the predetermined voltage level or less regarding the image area of the recording sheet, the time duration for applying the high voltage to the electricity removing needle regarding the tip and trail end areas of the recording sheet is lengthened, thereby improving the electricity removing ability.

Seventh embodiment

Next, a seventh embodiment of the present invention will be explained with reference to the accompanying drawings. A timing chart and a flowchart regarding the seventh embodiment are the same as those in the fourth embodiment.

Figure 30:
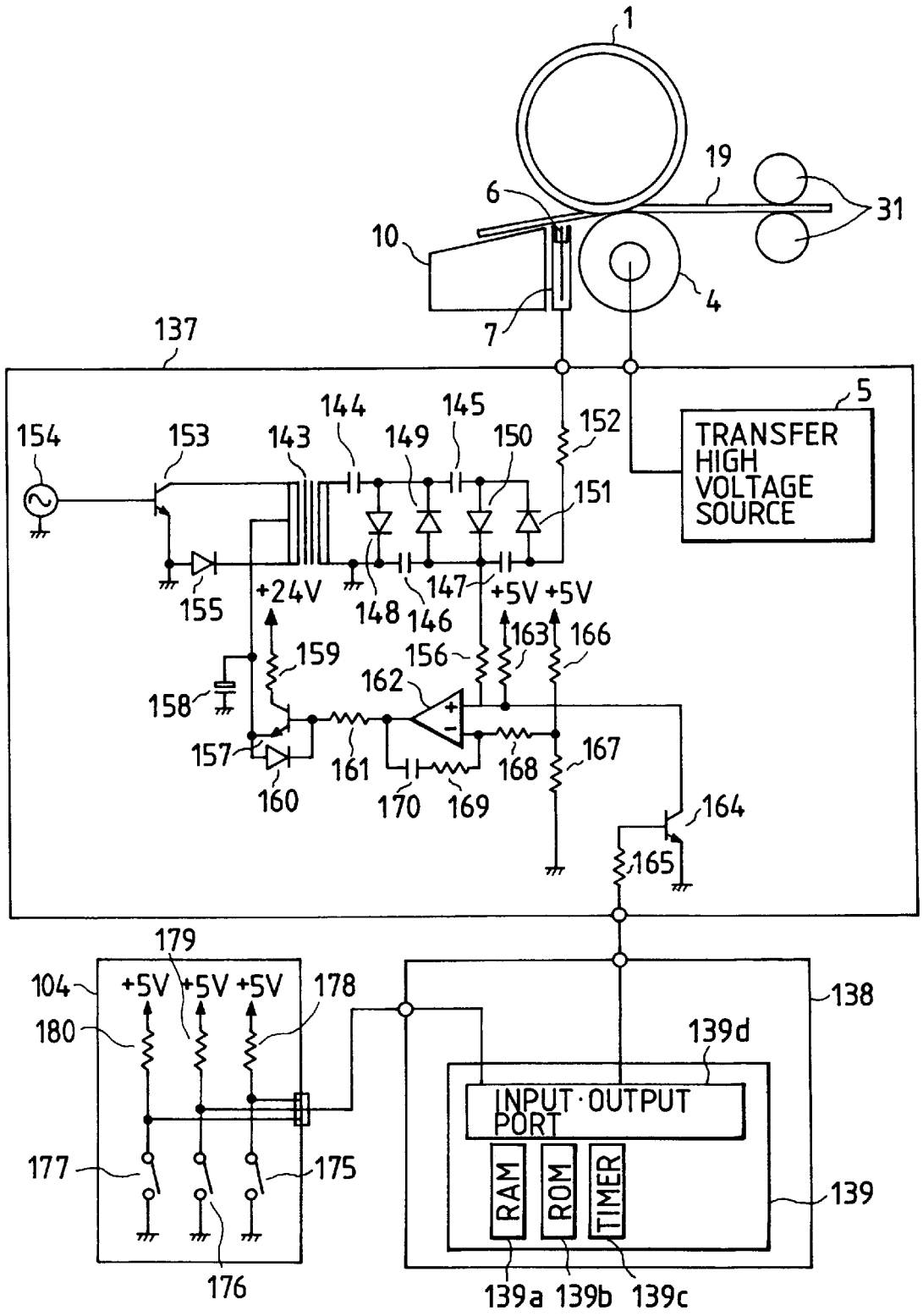
FIG. 30 is a circuit diagram of a high voltage power source for an electricity removing needle according to a seventh embodiment of the present invention.

FIG. 30 is a circuit diagram of the high voltage source for the electricity removing needle and therearound, according to the seventh embodiment. The seventh embodiment differs from the fourth embodiment in the point that the resistor 156 for detecting the output voltage is connected to a voltage doubler circuit, other than the output portion. The resistor 156 is connected to a position where the AC voltage generated at the output terminal of the inverter transformer 143 is doubled twice and voltage is ½ of the output high voltage.

In this way, since the control of the output voltage is effected by detecting the voltage in the rectifier portion smaller than the output voltage regarding the high voltage source for generating the high voltage applied to the electricity removing needle by using the constant voltage doubler system, even when the resistance value of the detection resistor is the same, the electric power applied to the detection resistor can be reduced, thereby quickening the rise of the high voltage output. Further, in some cases, since the maximum acceptable voltage or maximum acceptable electric power of the detection resistor can be reduced, the apparatus can be made cheaper.

Eighth embodiment

Figure 31:
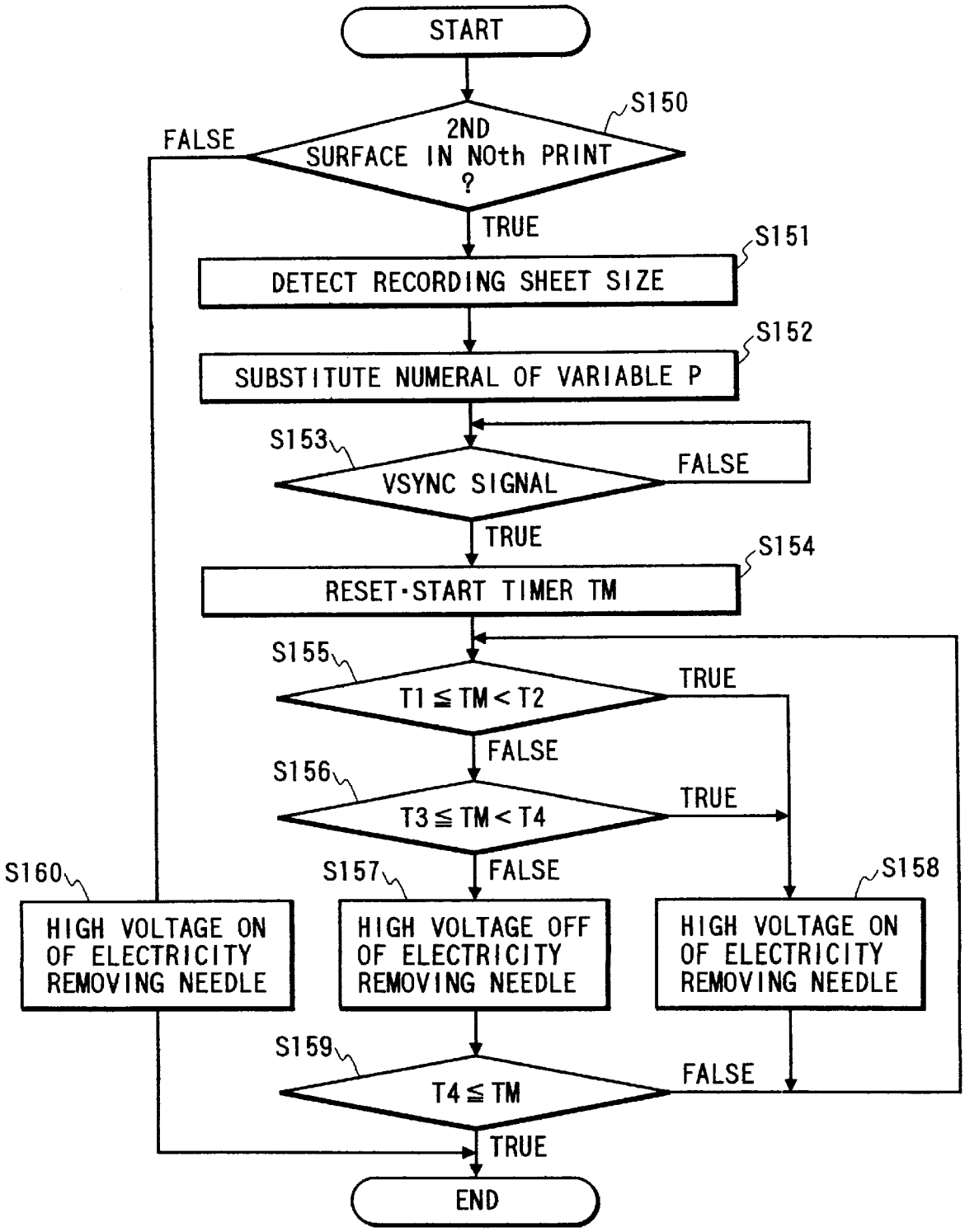
FIG. 31 is a flowchart according to an eighth embodiment of the present invention.

Next, an eighth embodiment of the present invention will be explained with reference to the accompanying drawings. A circuit diagram of the high voltage source for the electricity removing needle and a timing chart regarding the eighth embodiment are the same as those in the fourth embodiment. FIG. 31 is a flowchart according to the eighth embodiment. The eighth embodiment differs from the fourth embodiment in that the same control as the fourth embodiment is effected regarding the second surface of the recording sheet in the both-face image formation mode (steps S150–S159) and the high voltage of the electricity removing needle is turned OFF in the one-face image formation mode and regarding the first surface of the recording sheet in the both-face image formation mode (step S160).

In this way, in the laser printer in which the image can be formed on both surfaces of the recording sheet, since the high voltage is applied to the electricity removing needle only regarding the second surface of the recording sheet in the both-face image formation mode, when the recording sheet can be separated from the photosensitive drum by the curvature separating action other than the second surface of the sheet in the both-face image formation mode, power consumption can be suppressed and heat generation can also be suppressed accordingly.

Ninth embodiment

The application of bias voltage to the electricity removing needle is particularly effective to the separation of the thin sheet from the photosensitive drum 1. The thin sheets will be widely used from the view point of protection of wood resources. However, since the thin sheet has small resiliency, it is difficult to separate the thin sheet from the drum due to the electrostatic force of the drum. In a ninth embodiment of the present invention, the bias voltage applied to the electricity removing needle is changed in accordance with a thickness of a sheet.

Figure 32:
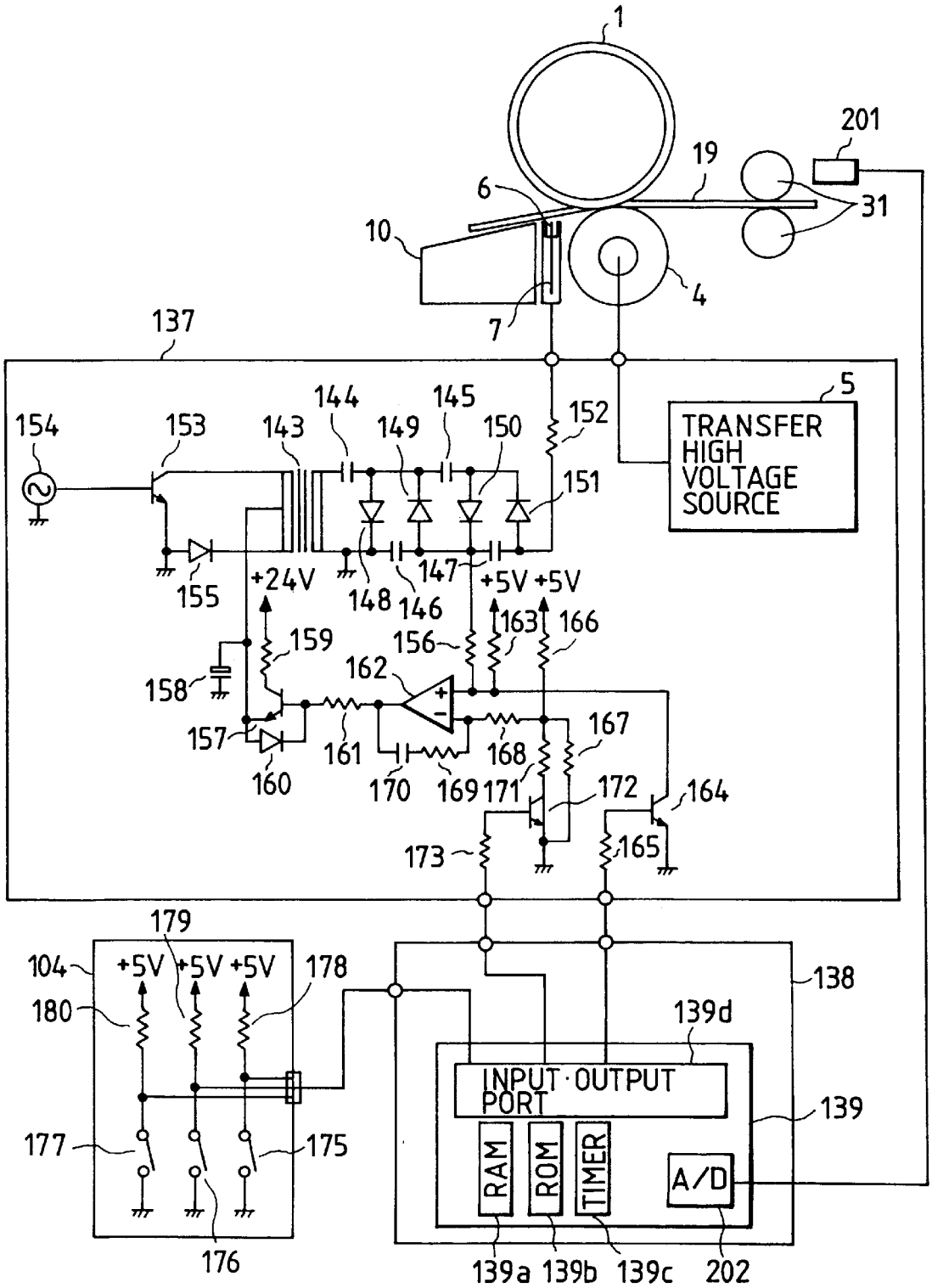
FIG. 32 is a circuit diagram according to a ninth embodiment of the present invention.

FIG. 32 is a circuit diagram according to the ninth embodiment.

The reference numeral 201 denotes a sheet thickness sensor of light reflection type or light permeable type. As the sheet thickness sensor of light reflection type, Z4D-A01 sensor sold by Omron can be used to accurately measure the thickness of the sheet by using triangular distant measurement. The sheet thickness sensor 201 is disposed in the sheet convey path at an upstream side of the transfer position. An output from the sensor which is in an analog form is received by an A/D converter 202 of the CPU 138.

Figure 33:
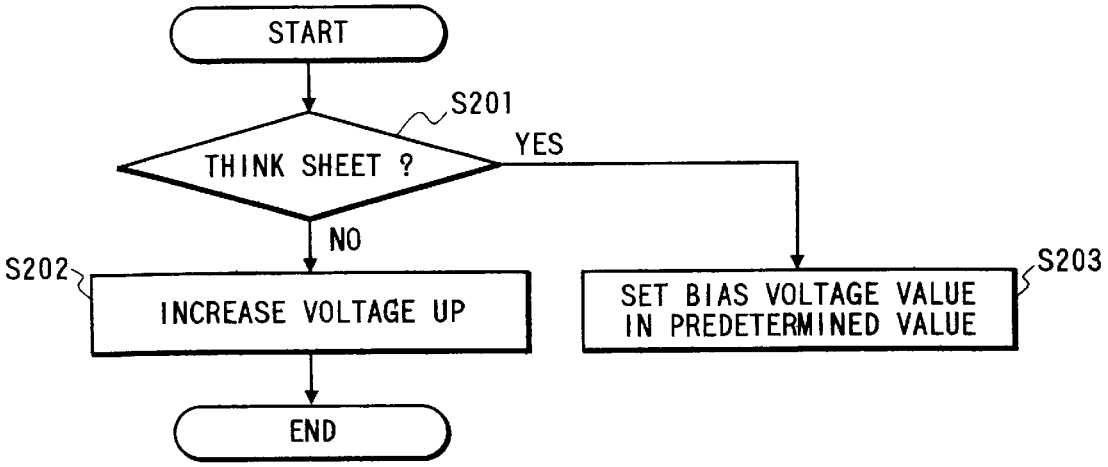
FIG. 33 is a flowchart according to the ninth embodiment.

Now, the operation of the CPU 138 will be explained with reference to a flowchart shown in FIG. 33.

In a step S201, the thickness of the sheet is checked. If the sheet thickness is smaller than a predetermined value, in a step S202, the signal is outputted from the I/O port 139*d* to increase the bias voltage. On the other hand, if the sheet thickness is greater than the predetermined value, in a step S203, the signal is outputted from the I/O port 139*d* to decrease the bias voltage. The voltage switching method is the same as the above-mentioned fifth embodiment.

Tenth embodiment

Figure 34:
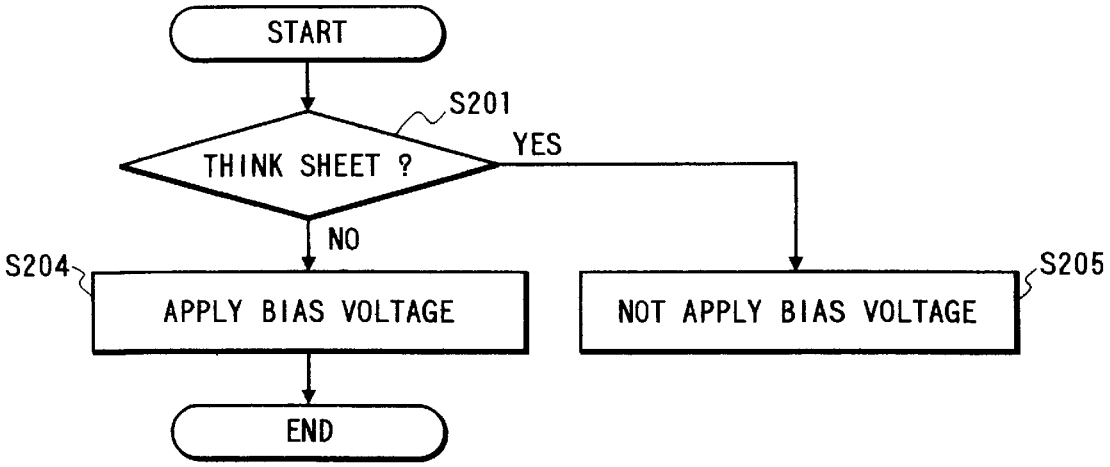
FIG. 34 is a flowchart according to a tenth embodiment of the present invention.

Lastly, a tenth embodiment of the present invention will be explained with reference to FIG. 34. In the tenth embodiment, only regarding the thin sheet, the bias voltage is applied to the electricity removing needle. As is in the ninth embodiment, in a step S201, the sheet thickness is checked. If the sheet thickness is smaller than a predetermined value, in a step S204, predetermined bias voltage is applied to the electricity removing needle. On the other hand, if the sheet thickness is greater than the predetermined value, in a step S205, any bias voltage is not applied to the electricity removing needle.

Incidentally, in the ninth and tenth embodiments, while an example in which the sheet thickness sensor is used was explained, the operator may previously input the kind of sheet through the operation portion or the sheet thickness may be determined from a mark provided on a sheet cassette containing a predetermined kind of sheets.

As mentioned above, according to the present invention, by adequately removing the electricity from the trail end of the transfer material, the poor image such as the rubbing of image and contamination of image due to the trail end splash can be prevented. Further, since the electricity is not removed from the central portion of the sheet excessively, the fixing offset and the transfer void under the high humidity condition can also be prevented. In addition, by adequately removing the electricity from the tip end of the transfer material, the tip end of the sheet can effectively be separated from the image bearing member.

Further, even when there is provided the guide for guiding the sheet after transferring and before fixing, the jam due to the electrostatic absorption of the sheet to the guide can be prevented. Particularly, by changing the level of the bias voltage applied to the electricity removing needle in accordance with the thickness of the transfer sheet, the kinds of sheets which can be handled is increased, and, regarding the thick sheets capable of being separated from the image bearing member by the curvature separating action, since the excessive bias voltage is not applied to the needle, the electric power can be saved. In addition, regarding the both-face image formation mode, by changing the bias voltage between the first surface and the second surface of the sheet, the electric power can be saved while maintaining the adequate separating ability.

What is claimed is:

1. An image forming apparatus comprising:

an image bearing member for bearing a toner image;

a transfer charging device for transferring the toner image from said image bearing member to a transfer material; and an electricity removing member for removing electricity from the transfer material at an electricity removing position to separate the transfer material from said image bearing member;

wherein a potential level applied to said electricity removing member is larger, in a tip end area of the transfer material and a trail end area thereof, than in a central area thereof, and a time, in which a potential level, larger than the potential level applied to the central area of the transfer material is applied, is longer in the trail end area of the transfer material than in the tip end area thereof.

2. An image forming apparatus according to claim 1, wherein said electricity removing member is subjected to voltage having charging polarity opposite to a voltage of said transfer charging device.

3. An image forming apparatus according to claim 1, wherein the image forming apparatus can transfer an image onto a second surface of the transfer material after an image has been transferred to a first surface of said transfer material, and when the image is transferred onto the second surface of the transfer material, said potential level is set so that the potential level at a tip and trail end area of the transfer material becomes greater than the potential level at a central portion of said transfer material along the transfer material shifting direction, wherein a time, in which a potential level, larger than the potential level applied to the central area of the transfer material is applied, is longer in the trail end area of the transfer material than in the tip end area thereof.

4. An image forming apparatus according to claim 3, when an image has been transferred onto a first surface of the transfer material, said potential level is set so that the potential level at a trail end area of the transfer material becomes greater than the potential level at a central portion of said transfer material along the transfer material shifting direction, and the potential level at the tip end area of the transfer material is the same as the potential level at the central area thereof.

5. An image forming apparatus according to claim 3, wherein, when the image is transferred onto the first surface of the transfer material, said potential level is set so that the potential level at a trail end area of the transfer material becomes greater than the potential level at the central portion of said transfer material along the transfer material shifting direction.

6. An image forming apparatus according to claim 1, wherein said potential level is increased before a trail edge of the transfer material passes a transfer position of said transfer charging device.

7. An imaging forming apparatus according to claim 1, wherein the image forming apparatus can transfer an image onto a second surface of the transfer material after an image has been transferred to a first surface of said transfer material, and said potential level at an end portion of the transfer material along the transfer material shifting direction is set so that the potential level regarding the second surface of the transfer material becomes greater than the potential level regarding the first surface of said transfer material.

8. An image forming apparatus according to claim 1, wherein, when a thickness of the transfer material is smaller than a predetermined value, said potential level at an end portion of the transfer material becomes greater than the potential level at the central portion of said transfer material along the transfer material shifting direction, and, when the thickness of the transfer material is greater than said predetermined value, said potential level at the end portion of the transfer material becomes the same as the potential level at the central portion of said transfer material.

9. An image forming apparatus according to claim 1, wherein, when a thickness of the transfer material is smaller than a predetermined value, a voltage is applied to said electricity removing member, and, when the thickness of the transfer material is greater than said predetermined value, the voltage is not applied to said electricity removing member.

10. An image forming apparatus according to claim 1, wherein, when a voltage of a power source for applying voltage to said electricity removing member rises above a predetermined level, overshoot is generated.

11. An image forming apparatus according to claim 6, wherein, in said image area of the transfer material along the transfer material shifting direction, a timing for starting rise of voltage applied to said electricity removing member is made faster than a timing when the transfer material reaches a transfer position so that said potential level becomes smaller than a predetermined value.

12. An image forming apparatus according to claim 1, wherein voltage applied to said electricity removing member is generated by constant voltage doubling, and control of said voltage is effected by detecting voltage in a rectifier portion smaller than the generated voltage.

13. An image forming apparatus according to claim 1, wherein a diameter of said image bearing member is 40 mm or less.

14. An image forming apparatus according to one of claims 1 to 13, wherein said transfer charging device is contacted with a surface of the transfer material conveyed between said image bearing member and said transfer charging device, which surface is opposite to the other surface of the transfer material directing toward said image bearing member.

15. An image forming apparatus according to claim 14, wherein said transfer charging device can be contacted with said image bearing member.

16. An image forming apparatus according to claim 14, wherein said transfer charging device is roller-shaped.

17. An image forming apparatus according to claim 1, wherein said electricity removing member has a sharp portion for inducing an electrical discharge.

18. An image forming apparatus comprising:

an image bearing member for bearing a toner image;

a transfer charging device for transferring the toner image from said image bearing member to a transfer material; and an electricity removing member for removing electricity from the transfer material to separate the transfer material from said image bearing member;

wherein, when a thickness of the transfer material is smaller than a predetermined value, a potential level applied to said electricity removing member at an end portion of the transfer material becomes greater than the potential level at the central portion of said transfer material along the transfer material shifting direction, and, when the thickness of the transfer material is greater than said predetermined value, said potential level at the end portion of the transfer material becomes the same as the potential level at the central portion of said transfer material.

19. An image forming apparatus according to claim 18, wherein the end portion of the transfer material is a tip end thereof along the transfer material shifting direction.

20. An image forming apparatus according to claim 18, wherein said electricity removing member is subjected to voltage having charging polarity opposite to a voltage of said transfer charging device.

21. An image forming apparatus according to one of claims 18 to 20, wherein said transfer charging device is contacted with a surface of the transfer material conveyed between said image bearing member and said transfer charging device, which surface is opposite to the other surface of the transfer material directing toward said image bearing member.

22. An image forming apparatus according to claim 21, wherein said transfer charging device is roller-shaped.

23. An image forming apparatus according to claim 18, wherein said electricity removing member has a sharp portion for inducing an electrical discharge.

24. An image forming apparatus comprising:

an image bearing member for bearing a toner image;

a transfer charging device for transferring the toner image from said image bearing member to a transfer material; and an electricity removing member for removing electricity from the transfer material at an electricity removing position to separate the transfer material from said image bearing member;

wherein a potential level applied to said electricity removing member is greater in a case wherein a trail end area of the transfer material is positioned at said electricity removing position than in a case wherein a tip end area of the transfer material is positioned at said electricity removing position.

25. An image forming apparatus according to claim 24, wherein the potential level applied to said electricity removing member is greater in a case wherein a trail end area of the transfer material is positioned at said electricity removing position than in a case wherein a central area of the transfer material is positioned at said electricity removing position.

26. An image forming apparatus according to claim 24, wherein said electricity removing member is subjected to voltage having a charging polarity opposite to a voltage of said transfer charging device.

27. An image forming apparatus according to claim 24, wherein the image forming apparatus can transfer an image onto a second surface of the transfer material after an image has been transferred to a first surface of the transfer material, and when the image is transferred onto the first surface of the transfer material, the potential level is set so that the potential level at a trail end area of the transfer material becomes greater than the potential level a tip end area of the transfer material along the transfer material shifting direction.

28. An image forming apparatus according to claim 25, wherein said apparatus can transfer an image onto a second surface of the transfer material after an image has been transferred to a first surface of the transfer material, and when an image has been transferred onto a first surface of the transfer material, said potential level is set so that the potential level at a trail end area of the transfer material becomes greater than the potential level at a tip end area of the transfer material along the transfer material shifting direction.

29. An image forming apparatus according to claim 27 or 28, wherein the image forming apparatus can transfer an image onto a second surface of the transfer material after an image has been transferred to a first surface of said transfer material, and when the image is transferred onto the second surface of the transfer material, said potential level is set so that the potential level at a tip and trail end areas of the transfer material becomes greater than the potential level at a central portion of said transfer material along the transfer material shifting direction.

30. An image forming apparatus according to claim 24, wherein said transfer charging device is contacted with a surface of the transfer material conveyed between said image bearing member and said transfer charging device, which surface is opposite to the other surface of the transfer material directed toward said image bearing member.

* * * * *

UNITED STATES PATENT AND TRADEMARK OFFICE

CERTIFICATE OF CORRECTION

PATENT NO. : 5,926,683

DATED : July 20, 1999

INVENTOR(S) : Takayasu YUMINAMOCHI, et al.

It is certified that error appears in the above-identified patent and that said Letters Patent is hereby corrected as shown below:

ON THE COVER:

At [56] FOREIGN PATENT DOCUMENTS:

"4-19976 1/1992 Japan" should read --4-19776 1/1992 Japan--.

COLUMN 7:

Line 63, "embodiment" should read --Embodiment--.

COLUMN 9:

Line 19, "embodiment" should read --Embodiment--.
Line 35, "in" should be deleted.
Line 36, "synchronous" should read --synchronously--.

COLUMN 11:

Line 15, "embodiment" should read --Embodiment--.
Line 26, "electrically" should read --electrical--.

COLUMN 12:

Line 37, "embodiment" should read --Embodiment--.
Line 59, "in synchronous" should read --synchronously--.

UNITED STATES PATENT AND TRADEMARK OFFICE

CERTIFICATE OF CORRECTION

PATENT NO. : 5,926,683

DATED : July 20, 1999

INVENTOR(S) : Takayasu YUMINAMOCHI, et al.

It is certified that error appears in the above-identified patent and that said Letters Patent is hereby corrected as shown below:

COLUMN 13:

Line 25, "switching-back" should read --switching back--.

COLUMN 15:

Line 24, "T2=Tt+(n1/V)-Tf." should read -- T2=Tt+(N1/V)-Tf.--.

COLUMN 16:

Line 11, "embodiment" should read --Embodiment--.
Line 49, "is" should be deleted.

COLUMN 17:

Line 15, "embodiment" should read --Embodiment--.
Line 67, "embodiment" should read --Embodiment--.

COLUMN 18:

Line 26, "embodiment" should read --Embodiment--.
Line 51, "embodiment" should read --Embodiment--.

UNITED STATES PATENT AND TRADEMARK OFFICE

CERTIFICATE OF CORRECTION

PATENT NO. : 5,926,683

DATED : July 20, 1999

INVENTOR(S) : Takayasu YUMINAMOCHI, et al.

It is certified that error appears in the above-identified patent and that said Letters Patent is hereby corrected as shown below:

COLUMN 19:

Line 16, "embodiment" should read --Embodiment--.

COLUMN 22:

Line 8 of Claim 27, "level" should read --level at--.

Signed and Sealed this

Twenty-fourth Day of October, 2000

*Attest:*

*Attesting Officer*

Q. TODD DICKINSON

*Director of Patents and Trademarks*